US009868292B2

(12) United States Patent
Matsui et al.

(10) Patent No.: US 9,868,292 B2
(45) **Date of Patent: *Jan. 16, 2018**

(54) INKJET RECORDING APPARATUS WITH TANK INCLUDING NOTIFICATION FEATURES

(71) Applicant: BROTHER KOGYO KABUSHIKI KAISHA, Nagoya-shi, Aichi-ken (JP)

(72) Inventors: Yuki Matsui, Kiyosu (JP); Kenta Horade, Tokai (JP); Mana Honoki, Nagoya (JP); Tomoya Oguchi, Nagoya (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/395,171

(22) Filed: Dec. 30, 2016

(65) Prior Publication Data

US 2017/0106659 A1 Apr. 20, 2017

Related U.S. Application Data

(63) Continuation of application No. 15/002,814, filed on Jan. 21, 2016, now Pat. No. 9,533,512.

(30) Foreign Application Priority Data

Jan. 21, 2015 (JP) ..... 2015-009881

(51) Int. Cl.
*B41J 2/175* (2006.01)

(52) U.S. Cl.
CPC ..... *B41J 2/17566* (2013.01)

(58) Field of Classification Search
CPC .. B41J 11/0095; B41J 11/009; B41J 2/14153; B41J 11/008; B41J 11/42; B41J 2/04505; B41J 2/04541; B41J 2/0458; B41J 3/28; B41J 11/06; B41J 2/04508; B41J 2/04558; B41J 2/07; B41J 2/17566; B41J 29/393

See application file for complete search history.

(56) References Cited

U.S. PATENT DOCUMENTS

| | | | |
|---|---|---|---|
| 8,827,396 | B2 | 9/2014 | Oguchi |
| 9,283,790 | B2 | 3/2016 | Tanaka |
| 9,393,791 | B2 | 7/2016 | Matsumoto et al. |
| 9,533,512 | B2 * | 1/2017 | Matsui ..... B41J 2/17566 |
| 2012/0050359 | A1 | 3/2012 | Koganehira et al. |

FOREIGN PATENT DOCUMENTS

| | | |
|---|---|---|
| JP | 2012-066563 A | 4/2012 |
| JP | 2013-6320 A | 1/2013 |

* cited by examiner

*Primary Examiner* — Lamson Nguyen
(74) *Attorney, Agent, or Firm* — Merchant & Gould P.C.

(57) ABSTRACT

An inkjet recording apparatus includes a tank forming an ink chamber and including an injection inlet, a recording head, a cover, a monitor, a cover sensor, an operation panel, and a controller. The controller controls operation of the recording head and the monitor. The controller performs decision processing deciding whether ink injection into the ink chamber after complement of an initial process is completed, and counts an amount of ink discharged from the recording head. The controller controls the monitor to display notification depending on the decision processing and the counted amount of discharged ink.

28 Claims, 13 Drawing Sheets

INKJET RECORDING APPARATUS WITH TANK INCLUDING NOTIFICATION FEATURES

CROSS REFERENCE TO RELATED APPLICATION

This application is a continuation of U.S. patent application Ser. No. 15/002,814, filed Jan. 21, 2016, and claims priority from Japanese Patent Application No. 2015-009881 filed Jan. 21, 2015. The entire content of both of these applications are incorporated herein by reference.

TECHNICAL FIELD

The present disclosure relates generally to an inkjet recording apparatus with a tank and a method for thereof including notification features.

BACKGROUND

A conventional inkjet recording apparatus known in the prior art has ink chambers in which inks can be refilled through supply holes, instead of using replaceable ink cartridges.

SUMMARY

In accordance with the present disclosure, an inkjet recording apparatus includes a tank forming an ink chamber and including an injection inlet, a recording head, a cover, a monitor, a cover sensor, an operation panel, and a controller. The controller controls operation of the recording head and the monitor. The controller performs decision processing deciding whether ink injection into the ink chamber after complement of an initial process is completed, and counts an amount of ink discharged from the recording head. The controller controls the monitor to display notification depending on the decision processing and the counted amount of discharged ink.

BRIEF DESCRIPTION OF THE DRAWINGS

The particular features and advantages of the disclosure will become apparent from the following description taken in connection with the accompanying drawings, in which:

FIG. 1A illustrates a state in which a cover is closed and FIG. 1B illustrates a state in which the cover is open;

DETAILED DESCRIPTION

Figure 1A:
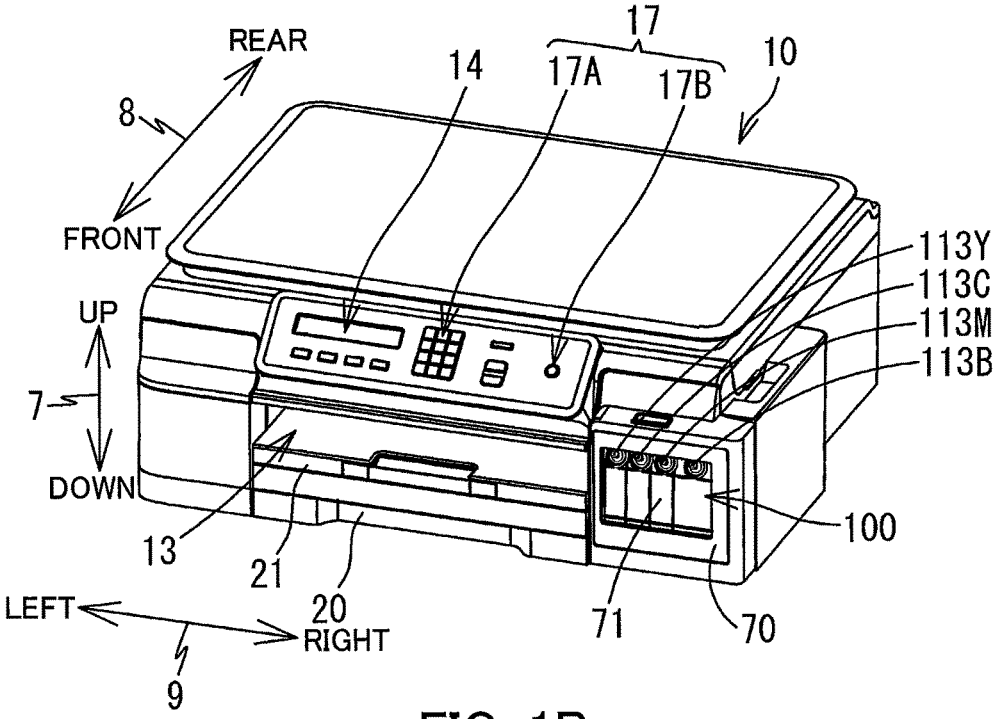
FIGS. 1A and 1B are each a perspective view illustrating the outside shape of a MFP.

An inkjet recording apparatus according to an embodiment will be described while referring to the accompanying drawings wherein like parts and components are designated by the same reference numerals to avoid duplicating description. The embodiment described below is only an example of the present invention; it will be appreciated that the embodiment can be appropriately changed without departing from the intended scope of the present invention.

In this description, an up-and-down direction 7 is defined with respect to a state in which a MFP 10 is installed so as to be ready for being used, a fore-and-aft direction 8 is defined by taking a side on which an opening 13 is formed in the MFP 10 as a near side (front surface side), and a right-and-left direction 9 is defined when the MFP 10 is viewed from the near side (front surface side).

<Whole Structure of the Multi-Function Peripheral 10>

Figure 1B:
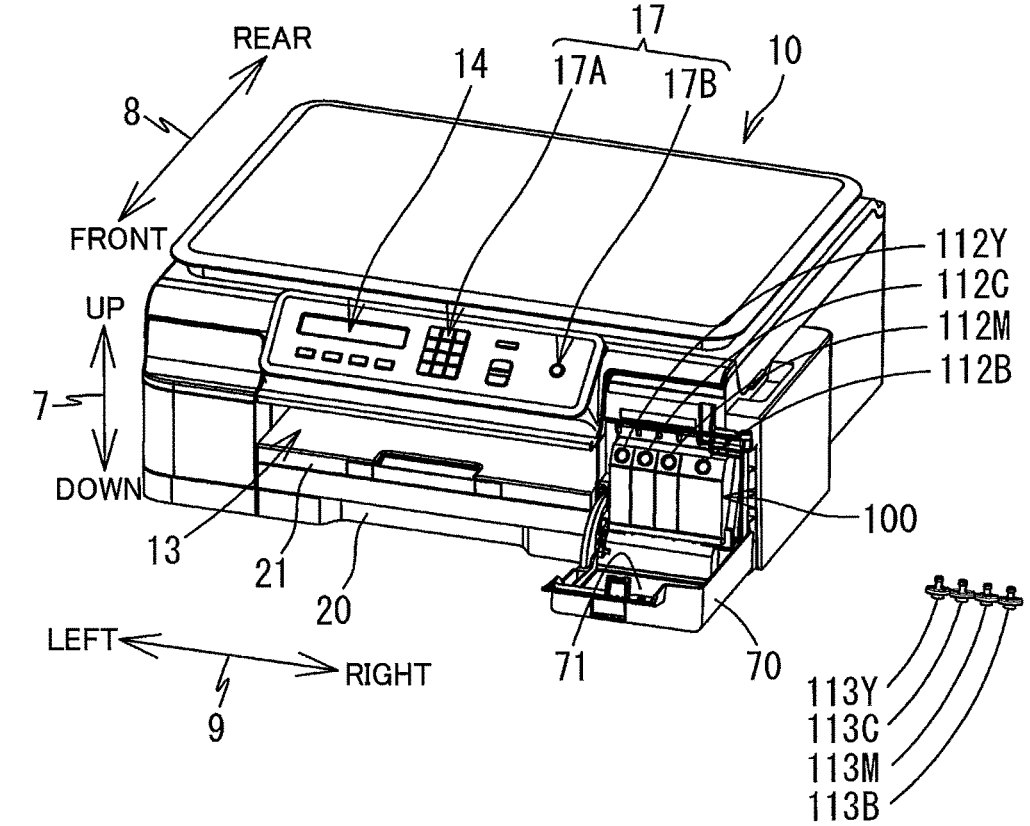

The multi-function peripheral 10 is a substantially rectangular parallelepiped body as illustrated in FIGS. 1A and 1B. The MFP 10 has print functions that print an image on a sheet in an inkjet printing method. As illustrated in FIGS. 1A, 1B, 2, and 7, the MFP 10 includes a feed tray 20, a discharge tray 21, a conveyor 23, a recording unit 24, and an ink tank 100. The MFP 10 is an example of an inkjet recording apparatus and a computer.

<Feed Tray 20 and Discharge Tray 21>

The user may insert the feed tray 20 into the MFP 10, or remove from the feed tray 20 as well. The user may remove feed tray 20 from the MFP 10 in the fore-and-aft direction 8 through the opening 13. The opening 13 is formed in the front surface of the MFP 10 at the center in the right-and-left direction 9, as illustrated in FIGS. 1A and 1B. The feed tray 20 is able to support a stack of a plurality of sheets. The discharge tray 21 is disposed above the feed tray 20. And the discharge tray 21 is able to support sheets discharged by the conveyor 23.

<Conveyor 23 and Recording Unit 24>

The conveyor 23 conveys a sheet supported on the feed tray 20 through a position at which the sheet faces the recording unit 24 to the discharge tray 21. The conveyor 23 has, for example, a roller that rotates while abutting a sheet. The recording unit 24 ejects ink retained in the ink tank 100 to record an image on the sheet conveyed by the conveyor 23. The recording unit 24 has, for example, a carriage that is movable in a direction crossing a direction in which the sheet is conveyed and also includes a recording head for ejecting ink, the recording head being mounted on the carriage.

Figure 2:
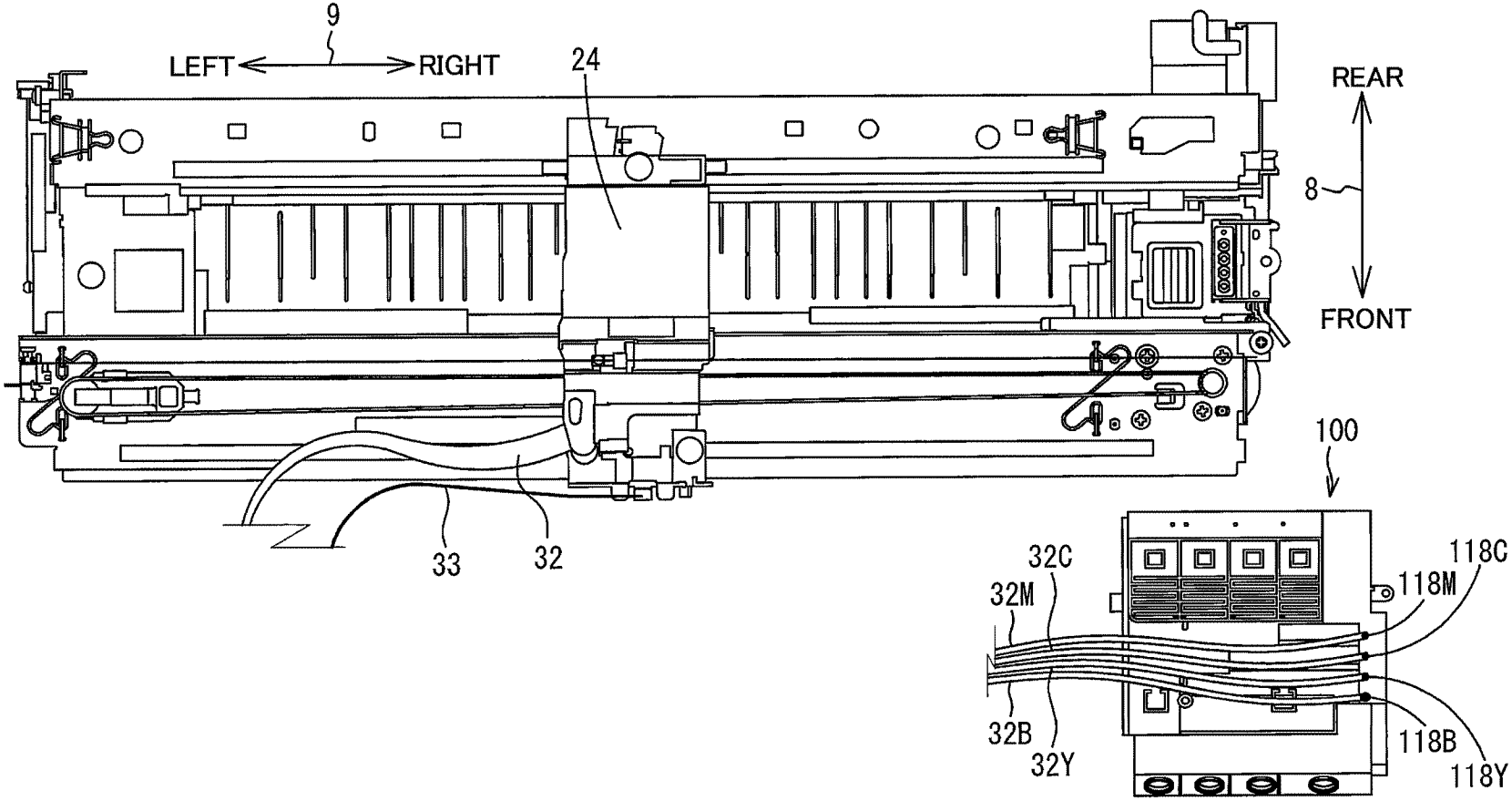
FIG. 2 is a plan view illustrating a recording unit and an ink tank.

Ink tubes 32 and a flexible flat cable 33 are connected to the recording unit 24, as illustrated in FIG. 2. Ink retained in the ink tank 100 is supplied to the recording unit 24 through the ink tubes 32. Specifically, four ink tubes 32B, 32M, 32C, and 32Y (sometimes collectively referred to below as the ink tubes 32), through which inks in black, magenta, cyan, and yellow are respectively supplied, extend from the ink tank 100 and are connected to the recording unit 24 in a state in which the ink tubes 32 are bound together. Control signals output from a controller 130 (see FIG. 7) are transmitted to the recording unit 24 through the flexible flat cable 33.

<Ink Tank 100>

The ink tank 100 is located in the MFP 10 as illustrated in FIGS. 1A and 1B. The ink tank 100 is fixed to the MFP 10 so that the ink tank 100 cannot be easily removed from the MFP 10. The ink tank 100 has a front wall 101, a right wall 102, a left wall 103, an upper wall 104, and a lower wall 105. The rear of the ink tank 100, which is open, is sealed with a film 106.

The front wall 101 defines the front ends of ink chambers 111 in the fore-and-aft direction 8. The front wall 101 is formed with a base wall 101A, which extends from the lower wall 105 substantially in the up-and-down direction 7 and an inclined wall 101B, which extends from the upper edge of the base wall 101A and is inclined backward with respect to the base wall 101A. The front wall 101 is translucent to a degree in which ink in the ink chambers 111 are visible to the user from the outside of the ink tank 100. Although, in the above description, only the front wall 101 is translucent, this is not a limitation; all walls 101 to 105 may be translucent.

Figure 5:
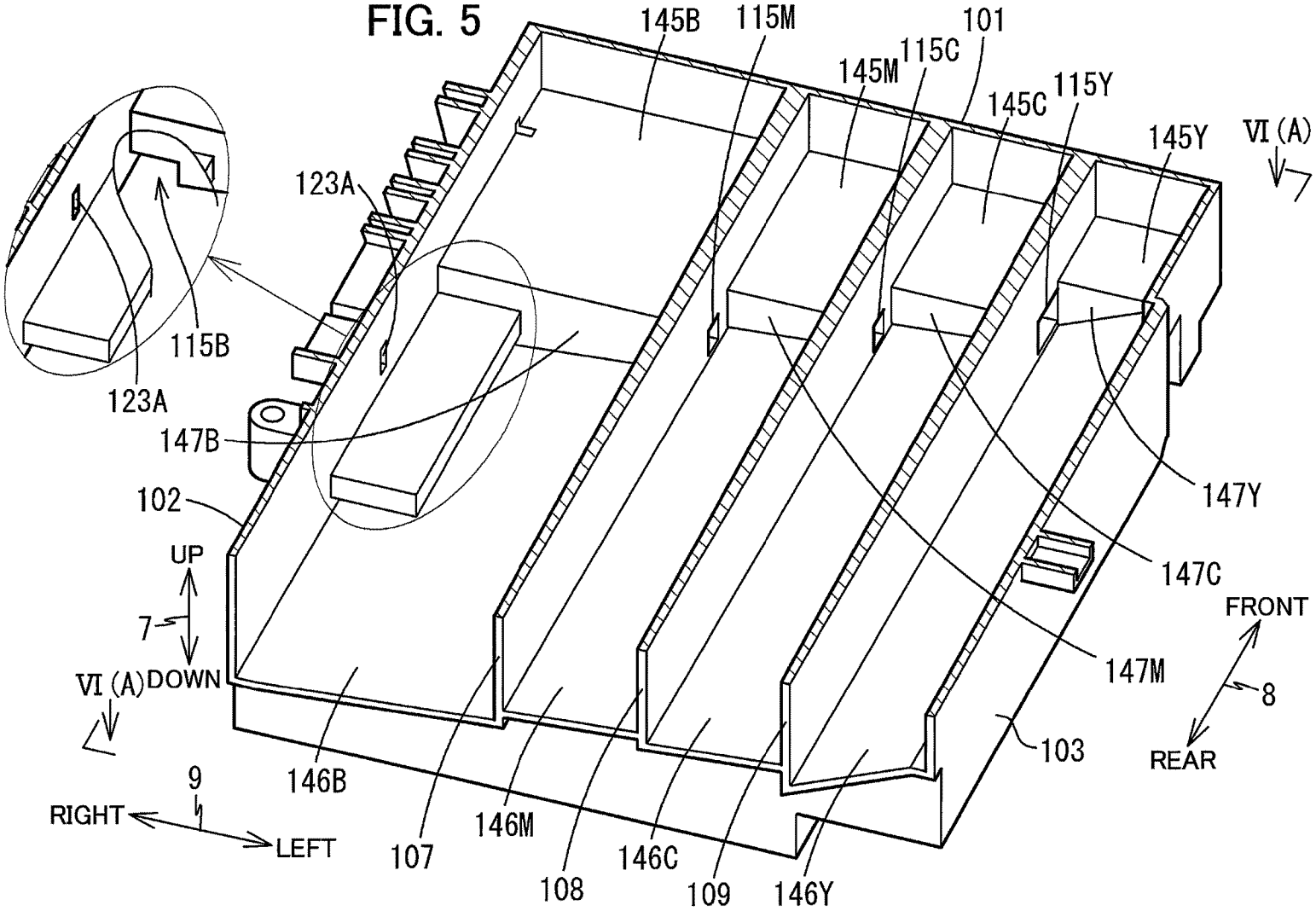
FIG. 5 is a perspective cross-sectional view taken along line V-V in FIG. 3.
Figure 6A:
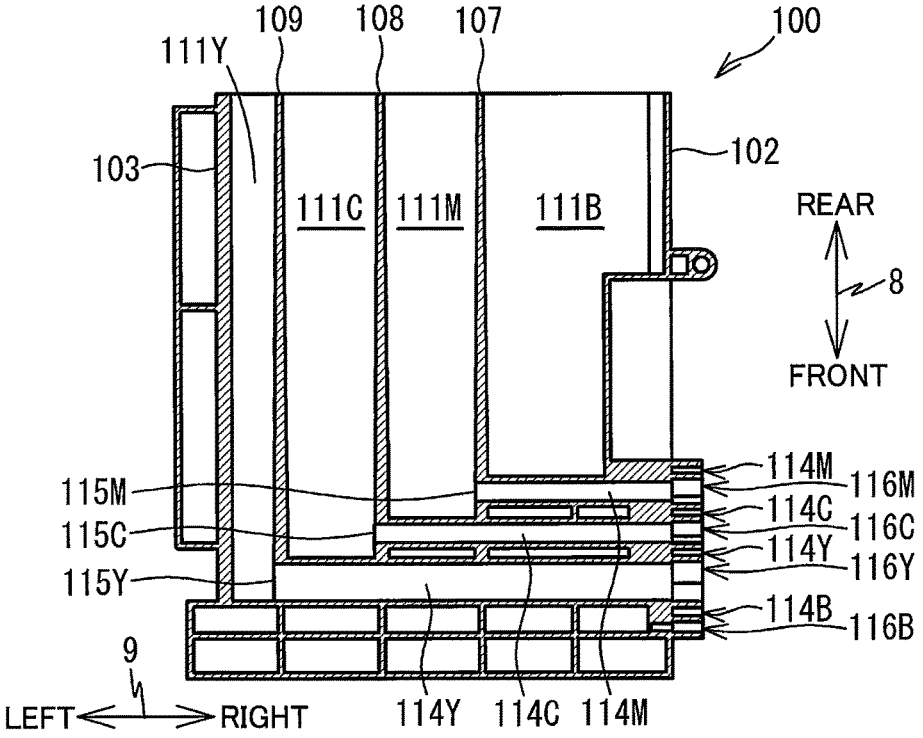
FIG. 6A is a cross-sectional view taken along line VI(A)-VI(A) in FIG. 5.
Figure 6B:
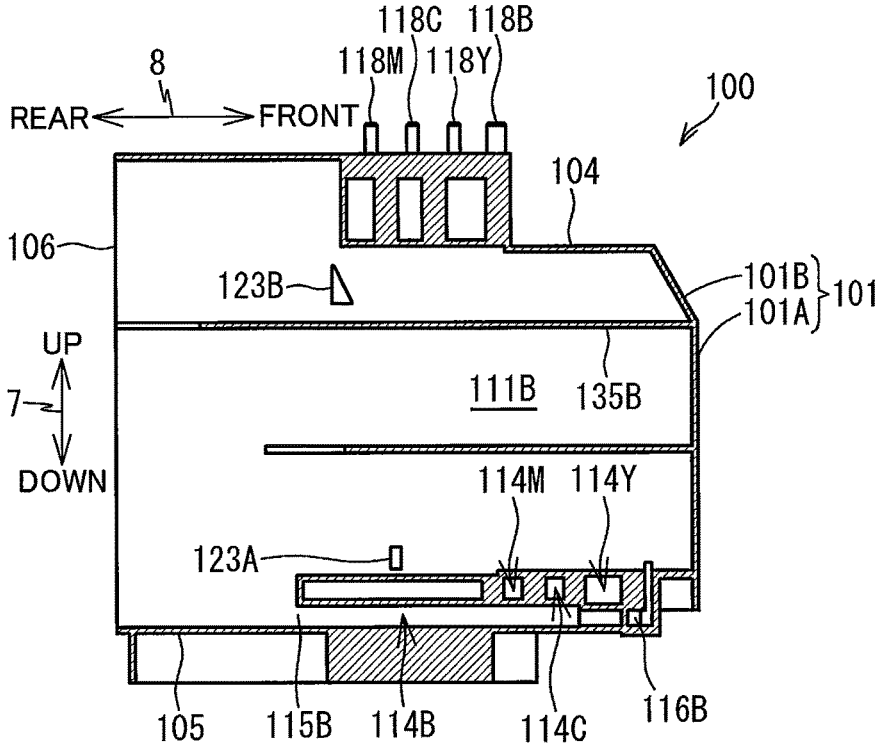
FIG. 6B is a cross-sectional view taken along line VI(B)-VI(B) in FIG. 3.

The lower wall 105 defines the lower ends of the ink chambers 111 in the up-and-down direction 7. As illustrated in FIG. 5, the lower wall 105 has upper-stage walls 145, lower-stage walls 146, and connecting walls 147. The upper-stage walls 145 are in contact with the inner surface of the front wall 101 (specifically, the base wall 101A). The lower-stage walls 146 are in contact with the film 106. The lower-stage walls 146 are positioned below the upper-stage walls 145 and behind the upper-stage walls 145. The upper edge of each connecting wall 147 is connected to the rear edge of the corresponding upper-stage wall 145, and the lower edge of the connecting wall 147 is connected to the front edge of the corresponding lower-stage wall 146.

<Ink Chambers 111>

Figure 4:
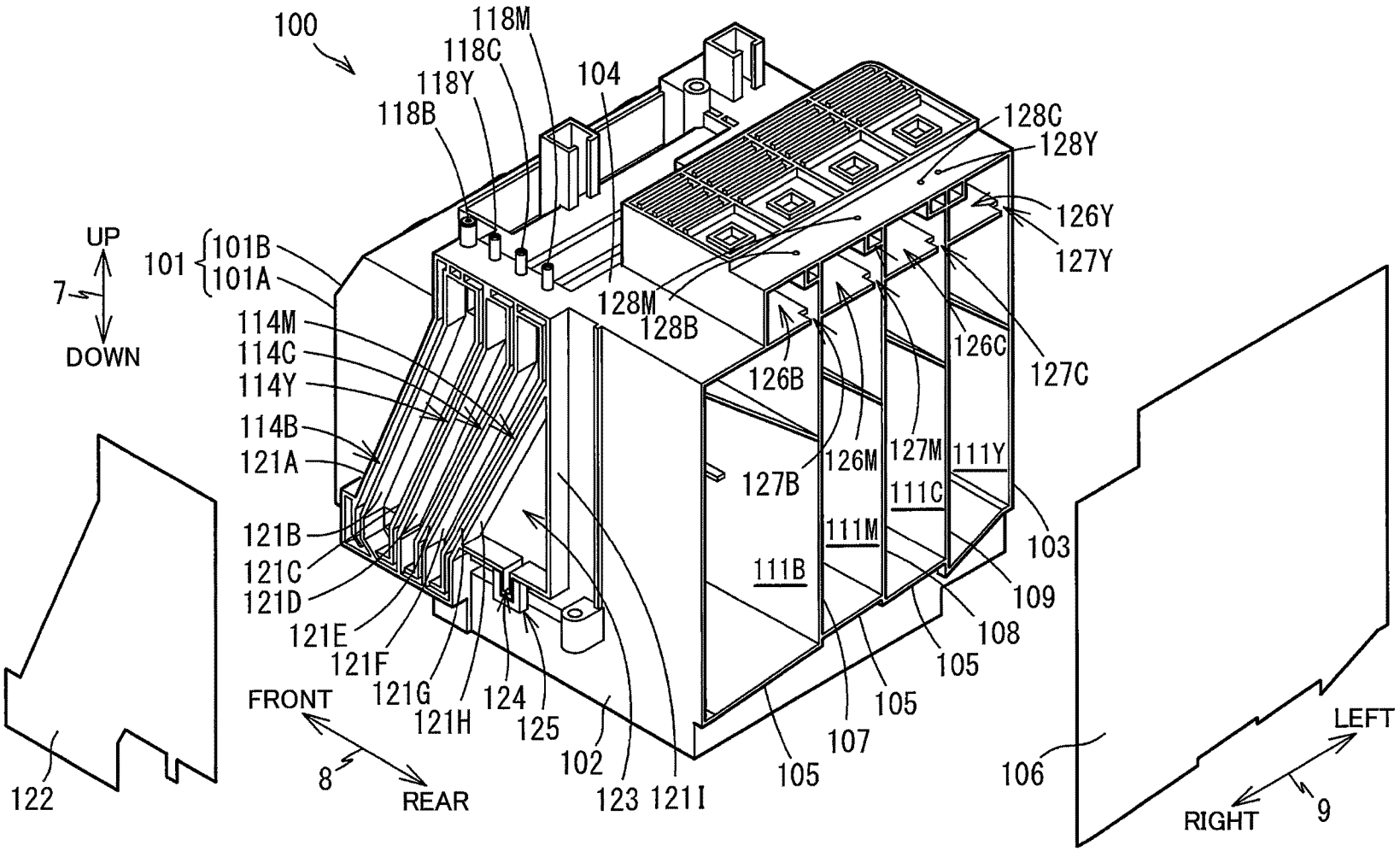
FIG. 4 is a backward perspective view of the ink tank.

The ink tank 100 has a plurality of partition walls 107, 108, and 109 that partition the internal space of the ink tank 100, as illustrated in FIG. 4. The partition walls 107 to 109 extend in the up-and-down direction 7 and fore-and-aft direction 8 and are in contact with the front wall 101, upper wall 104, lower wall 105, and film 106. The partition walls 107 to 109 are spaced in the right-and-left direction 9, partitioning the internal space of the ink tank 100 into four ink chambers 111B, 111M, 111C, and 111Y in which ink is retained.

Inks in different colors are retained in the ink chambers 111B, 111M, 111C, and 111Y. Specifically, ink in black is retained in the ink chamber 111B, ink in cyan is retained in the ink chamber 111C, ink in magenta is retained in the ink chamber 111M, and ink in yellow is retained in the ink chamber 111Y. An ink bottle which is filled with a predetermined amount of ink is provided as ink to be supplied into the corresponding ink chamber 111.

However, the form of the ink tank 100 is not limited to the example described above. For example, the MFP 10 may have four ink tanks each of which has an ink chamber in which ink in a different color is retained. The number of ink chambers 111 and the colors of inks in them are not limited to the example described above. For example, only the ink chamber 111B, in which ink in black is retained, may be provided. The ink chambers 111B, 111M, 111C, and 111Y may be collectively referred to below as the ink chambers 111. Each four constituent elements corresponding to the ink chambers 111 (such as injection inlets 112B, 112M, 112C, and 112Y and ink flow paths 114B, 114M, 114C, and 114Y, which will be described later) are assigned reference characters that differ only in suffixes (B, M, C, and Y). When these four elements are collectively referenced, they may be denoted by the same reference numeral without these suffixes (as in the form of injection inlets 112 and ink flow paths 114, which will be described later).

As shown in FIG. 5, each ink chamber 111 has a recessed part 119 formed in its lower part. The recessed part 119 is enclosed by the lower-stage wall 146 and connecting wall 147, and located behind and below the upper-stage wall 145 (the space will be referred to as the spare retaining chamber).

Now, the amount of ink in an ink bottle, described later, will be denoted $V_{max}$ and the spare retaining chamber will be denoted $V_0$. Then, a remaining amount threshold is represented as $V_0$, a first discharge threshold is represented as $[V_{max}-(V_0-\alpha)]$; a second discharge threshold is represented as $[(V_{max}+V_0-(V_0-\alpha)]=(V_{max}+\alpha)$; a third discharge threshold is represented as $(V_{max}-V_0)$; and a fourth discharge threshold is represented as $(V_{max}+V_0-V_0)=V_{max}$. Although there is no particular limitation on the specific value of $\alpha$, its value may be determined, for example, as described below.

The value of $\alpha$ corresponds to, for example, the volume of the spare retaining chamber between the upper surface of the upper-stage wall 145 and the upper edge of an opening 115. Specifically, $\alpha$ may be set to a value that is equal to the volume of the spare retaining chamber or is slightly smaller than the volume. Thus, in image recording processing described later, it is possible to suppress the liquid level of ink in the ink chamber 111 from falling below the upper edge of the opening 115, which would otherwise cause air to enter the ink flow path 114, the ink tube 32, and the recoding head of the recording unit 24. The value of a is larger than 0 and is smaller than $(V_{max}-V_0)$ and $V_0$.

The first discharge threshold is an example of a first threshold value, and the second discharge threshold is an example of a second threshold value. As described above, the first discharge threshold is smaller than the second discharge threshold by the volume of the spare retaining chamber, $V_0$. The amount of ink in the ink bottle, $V_{max}$ is set smaller than the volume of each ink chamber 111. The first, second, third, and fourth discharge threshold are the values compared to a counted value, described later. Incidentally, the first to fourth discharge thresholds are referred to as discharge thresholds, and the ink chambers 111 may set the remaining amount thresholds or the discharge thresholds that differ from each ink chamber.

<Injection Inlets 112>

Injection inlets 112B, 112M, 112C, and 112Y, from which ink is injected into their corresponding ink chambers 111, are formed in the inclined wall 101B of the ink tank 100. Each injection inlet 112 passes through the inclined wall 101B in its thickness direction so that the corresponding ink chamber 111 communicates with the outside of the ink tank 100. The inner surface of the inclined wall 101B faces the interior of each ink chamber 111, and the outer surface of the inclined wall 101B faces the outside of the ink tank 100. The injection inlets 112 may be formed in the upper wall 104 instead of the inclined wall 101B.

The ink tank 100 has caps 113B, 113M, 113C, and 113Y, which can be attached to their corresponding injection inlets 112 and can be removed from them. As illustrated in FIG. 1A, the cap 113 attached to the injection inlet 112 is in tight contact with the circumferential edge of the injection inlet 112, blocking the injection inlet 112. When the cap 113 is removed from the injection inlet 112, the injection inlet 112 is opened as illustrated in FIG. 1B. The cap 113 is attached to the injection inlet 112 and is removed from it in a state in which a cover 70 described later, is located at an exposed position. When the user removes the cap 113 from the injection inlet 112, the user can inject ink from the corresponding ink bottle into the ink chambers 111.

Each ink chamber 111 in the ink tank 100 is replenished with ink contained in a single bottle (not shown). The open end of the bottle is inserted into the corresponding injection inlet 112 and ink in the bottle is allowed to flow into the ink chamber 111 of the ink tank 100. More specifically, the bottle has a nozzle that is inserted into the injection inlet 112. Ink contained in the bottle flows out of the nozzle into the ink chamber 111.

<Ink Flow Paths 114>

Ink flow paths 114B, 114M, 114C, and 114Y are formed in the ink tank 100 as illustrated in FIGS. 4, 5, 6A, and 6B. The ink flow paths 114M, 114C, and 114Y respectively communicate with the ink chambers 111M, 111C, and 111Y through openings 115M, 115C, and 115Y. The openings 115M, 115C, and 115Y are respectively formed in the vicinity of the lower edges of the partition walls 107, 108, and 109. The flow path 114B communicates with the ink chamber 111B through an opening 115B. The opening 115B is formed in the vicinity of a boundary between the right wall 102 and the lower wall 105. The openings 115B, 115M, 115C, and 115Y are openings confronting the corresponding spare retaining chambers (i.e., the recessed parts 119 formed in the bottom of the ink chambers 111). Thus, the ink chambers 111B, 111M, 111C, and 111Y have corresponding openings 115B, 115M, 115C, and 115Y formed near their bottom surfaces to allow the outflow of ink. The openings 115B, 115M, 115C, and 115Y are included in the corresponding spare retaining chambers that constitute the recessed parts 119. The openings 115B, 115M, 115C, and 115Y are examples of the outlets. The ink flow paths 114B, 114M, 114C, 114Y respectively extend from their corresponding openings 115 through openings 116B, 116M, 116C, and 116Y. The openings 116B, 116M, 116C, and 116Y are formed in the right wall 102 to the right side surface of the ink tank 100.

Each ink flow path 114 further extends upwardly from the opening 116 along the outer surface of the right wall 102 and is connected to a linking portion 118. Four linking portions 118 are formed so as to protrude toward the upper wall 104 of the ink tank 100. The four ink tubes 32B, 32M, 32C, and 32Y corresponding to inks in the four colors are connected to these linking portions 118 (see FIG. 2). That is, each ink flow path 114 is a flow path that leads ink flowed out from its corresponding ink chamber 111 through the ink tube 32 liked to its corresponding linking portion 118 to the recording unit 24.

A plurality of protruding walls 121A to 121I are formed on the right wall 102 of the ink tank 100 as illustrated in FIG. 4. Each protruding wall 121 protrudes from the outer surface (right side surface) of the right wall 102 to the right and extends along the outer surface of the right wall 102. A film 122 is attached to the right ends of the protruding walls 121A to 121I by being melted. Each ink flow path 114 between its corresponding opening 116 and linking portion 118 is a space defined by the film 122 and adjacent two of the protruding walls 121A to 121H.

<Additional Ink Chamber 123>

An additional ink chamber 123 is further formed in the right side surface of the ink tank 100. The additional ink chamber 123 is defined by the right wall 102, the protruding walls 121H and 121I, which are contiguous in the circumferential direction, and the film 122. The additional ink chamber 123 communicates with the ink chamber 111B through through-holes 123A and 123B. Through-holes 123A and 123B pass through the right wall 102. In the additional ink chamber 123, a to-be-detected portion 124 is formed by enclosing the front, rear, and bottom of the through-hole 123A with part of the protruding wall 121I, which defines the lower edge of the additional ink chamber 123.

The lower edge of the through-hole 123A (that is, the lower edge of the to-be-detected portion 124) is located below the upper surface of the upper-stage wall 145B. Therefore, if the amount of ink in the ink chamber 111B is equal to or larger than the remaining amount threshold, ink enters the to-be-detected portion 124 through the through-hole 123A. If the amount of ink in the ink chamber 111B is smaller than the remaining amount threshold, ink in the to-be-detected portion 124 is discharged through the through-hole 123A to the ink chamber 111B, so ink is no longer present in the to-be-detected portion 124.

<Ink Sensor 125>

Figure 3:
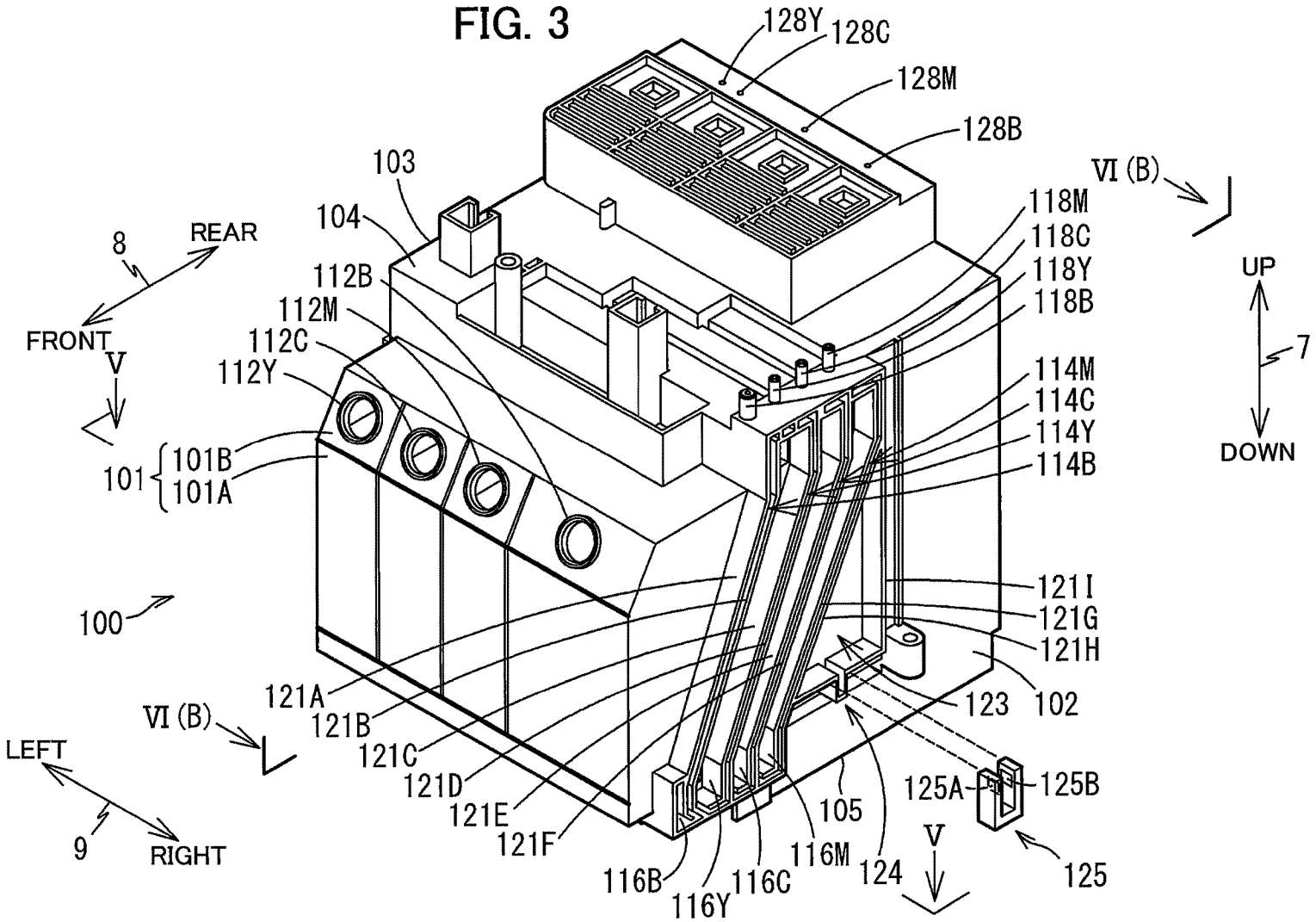
FIG. 3 is a forward perspective view of the ink tank.

The MFP 10 has an ink sensor 125 as illustrated in FIGS. 3 and 4. The ink sensor 125 has a light emitter 125A and a light receiver 125B. The light emitter 125A and the light receiver 125B are disposed so as to face each other in the fore-and-aft direction 8 with the to-be-detected portion 124 intervening between them. The light emitter 125A emits light toward the light receiver 125B. The light is, for example, visible light or infrared light so that the light transmits through the protruding wall 121I but does not transmit through black ink. The light receiver 125B outputs a different remaining amount signal to the controller 130, depending on whether the light receiver 125B has received light emitted from the light emitter 125A. In other words, the ink sensor 125 outputs a different remaining amount signal to the controller 130, depending on the amount of ink retained in the ink chamber 111B.

Based on the detection that ink is present in the to-be-detected portion 124 (in other words, the amount of ink in the ink chamber 111B is equal to or larger than the remaining amount threshold), the ink sensor 125 outputs a first signal. Based on the detection that ink is not present in the to-be-detected portion 124 (in other words, the amount of ink in the ink chamber 111B is smaller than the remaining amount threshold), the ink sensor 125 outputs a second signal. The signal level of the first signal of the ink sensor 125 is 0 V and the signal level of the second signal of the ink sensor 125 is 3.3 V. That is, when the ink sensor 125 outputs a signal, a case in which the signal level is 0 V is also included. However, a combination of the signal levels is not limited to the example described above. This is also true for positional signals output from a cover sensor 72 described later.

That is, if black ink from single ink bottle is injected into the empty ink chamber 111B and ink is then consumed by an amount corresponding to the third or fourth discharge threshold, the liquid level of ink remaining in the ink chamber 111B substantially matches the height of the upper surface of the upper-stage wall 145B. At that time, the first signal output from the ink sensor 125 is present. If the amount of ink consumed reaches the first or second discharge threshold, the liquid level of ink remaining in the ink chamber 111B is below the upper-stage wall 145B. At that time, the second signal output from the ink sensor 125 is present.

<Air Communicating Paths 126>

The ink tank 100 forms air communicating paths 126B, 126M, 126C, and 126Y as illustrated in FIG. 4. Through each air communicating path 126, its corresponding ink chamber 111 communicates with the air. Specifically, the air communicating path 126 communicates with its corresponding ink chamber 111 through a cutout 127 formed at the upper edge of the ink chamber 111 and also communicates with the outside of the ink tank 100 through an opening 128.

<Cover 70>

The MFP 10 has the cover 70 as illustrated in FIGS. 1A and 1B. The cover 70 is rotatably supported by the MFP 10. The cover 70 can be rotated to a covered position illustrated in FIG. 1A and to the exposed position illustrated in FIG. 1B.

At the covered position, the cover 70 covers part of all injection inlets 112, restricting ink from being injected into any of all the ink chambers 111. When the cover 70 is positioned at the covered position, part of each injection inlet 112 (in other words, part of each cap 113) is covered. Then, if the user attempts to remove a cap 113, the attempt fails because the cover 70 covers part of the corresponding cap 113. That is, the cover 70 at the covered position restricts each cap 113 from being removed, restricting each injection inlet 112 from being opened. Therefore, the cover 70 at the covered position restricts ink from being injected to any of all the ink chambers 111. However, whole of each injection inlet 112 is covered by the cover 70. Specifically, the cover 70 only needs to be structured so that the cover 70 at the covered position restricts ink from being injected into each ink chamber 111. At the exposed position, the cover 70 is open and all injection inlets 112 are exposed to the outside of the MFP 10, allowing ink to be injected into all ink chambers 111.

A series of user's operations to inject ink is, for example, as described below. First, the user moves the cover 70 at the covered position to the exposed position and removes the cap 113 from the injection inlet 112 corresponding to the color of ink that the user is injecting. The user then inserts the top of an ink bottle into the injection inlet 112, which has been opened, and completely injects the ink in the ink bottle into the ink chamber 111. Upon completion of the injection of the ink, the user attaches the cap 113, which has been removed, to its corresponding injection inlet 112 and moves the cover 70 to the covered position.

The cover 70 has a transparent window 71, which faces the front wall 101 of the ink tank 100 with the cover 70 positioned at the covered position. Therefore, the user can visually check the amount of ink remaining in each ink chamber 111 through the front wall 101, regardless of whether the cover 70 is at the covered position or exposed position. The transparent window 71 is formed so that a height to the lower edge of the transparent window 71 in the cover 70 (position of the lower edge of the transparent window 71 in the up-and-down direction 7) substantially matches the height of each upper-stage wall 145. Therefore, if ink is retained only in a spare retaining chamber, it is difficult for the user to view the ink, so the user can determine at a glance that ink is not retained in the ink chamber 111.

<Cover Sensor 72>

Figure 7:
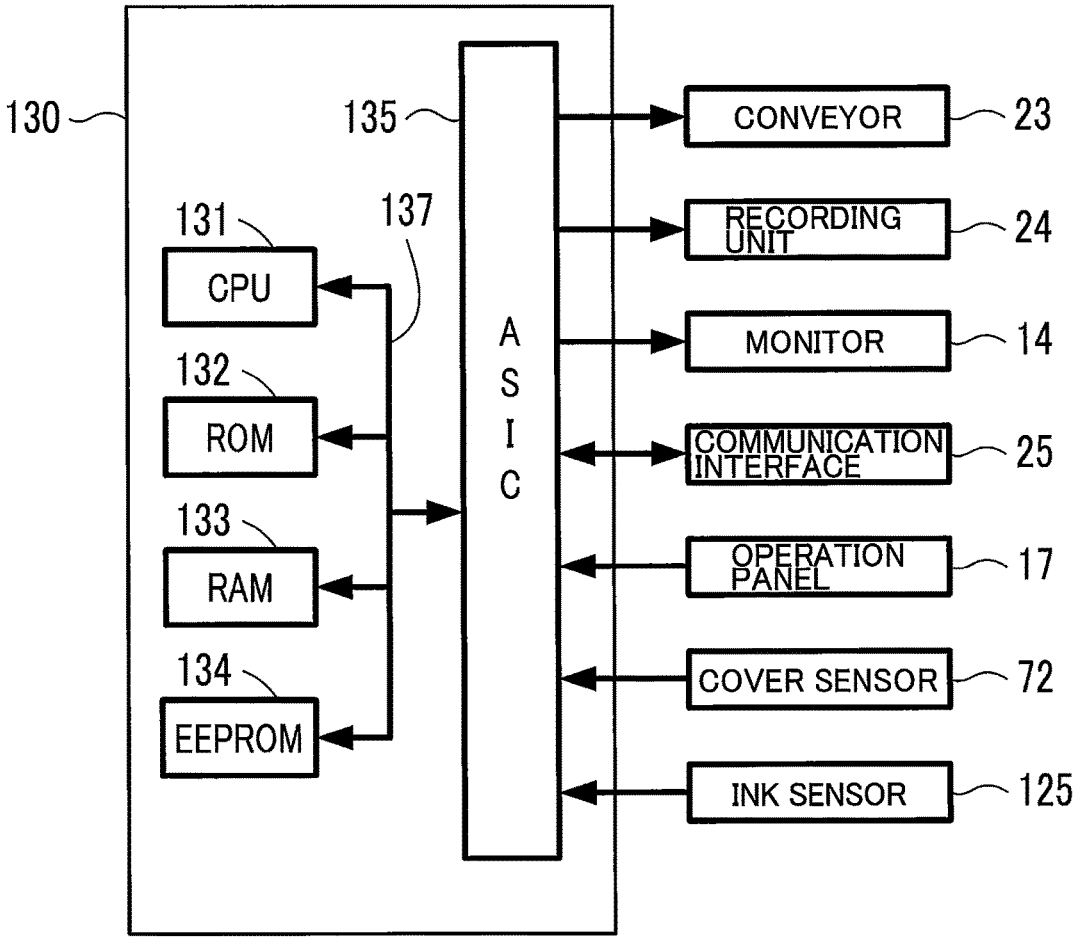
FIG. 7 is a block diagram of the MFP.

The MFP 10 further has the cover sensor 72 (see FIG. 7). The cover sensor 72 may be, for example, a switch that the cover 70 opens and closes by making or breaking a contact or another mechanical switch. Alternatively, the cover sensor 72 may be an optical sensor that allows or blocks transmission of light, depending on the position of the cover 70 or the movement. The cover sensor 72 outputs a different positional signal to the controller 130, depending on the position of the cover 70. The cover sensor 72 outputs, to the controller 130, a first positional signal when the cover 70 is positioned at the covered position and a second positional signal when the cover 70 is positioned at the exposed position. The signal level of the first positional signal of the cover sensor 72 is 0 V and the signal level of the second positional signal of the cover sensor 72 is 3.3 V.

<Monitor 14>

The MFP 10 includes a monitor 14 as illustrated in FIGS. 1A and 1B. The monitor 14 displays information of which the user should be notified as a message. There is no particular limitation on the specific structure of the monitor 14. For example, a liquid crystal display, an organic electroluminescence (EL) display, or the like can be used.

The monitor 14 is rectangular with eight dots vertically and 80 dots horizontally. That is, the monitor 14 can display up to 16 characters (including spaces) each of which has a size of eight dots vertically by five dots horizontally (about 8 mm vertically by about 5 mm horizontally). If a character string to be displayed on the monitor 14 includes more than 16 characters, the character string is displayed by being scrolled. When character strings in a plurality of rows are displayed on the monitor 14, a character string in one row is displayed in turn.

<Operation Panel 17>

The MFP 10 includes an operation panel 17 as illustrated in FIGS. 1A and 1B. The operation panel 17 is an input interface that accepts a command for the MFP 10 from the user. The operation panel 17 has a plurality of pushbuttons including, for example, a numeric keypad 17A and a power button 17B. However, the specific structure of the operation panel 17 is not limited to pushbuttons. The operation panel 17 may be a touch sensor superimposed on a screen displayed on the monitor 14.

The operation panel 17 outputs, to the controller 130, an operation signal in response to a pushbutton that has been pushed. The operation panel 17 outputs, to the controller 130, a first operation signal, a second operation signal, and the third operation signal. The operation panel 17 outputs the first operation signal (one example of an operation signal) in response to the pressing of a button labeled 1, which is included in the numeric keypad 17A. The operation panel 17 outputs the second operation signal in response to the pressing of a button labeled 2, which is included in the numeric keypad 17A. The operation panel 17 outputs the third operation signal in response to the pressing of the power button 17B. The buttons corresponding to the first operation signal, second operation signal, and third operation signal are not limited to the above examples.

<Communication Interface 25>

The MFP 10 includes a communication interface 25 as illustrated in FIG. 7. The communication interface 25 is an interface through which the MFP 10 communicates with an external apparatus. Specifically, the MFP 10 outputs various types of data to the external apparatus through the communication interface 25, and receives various types of data from the external apparatus through the communication interface 25. The communication interface 25 may function as a facsimile receiver that receives facsimile data from the external apparatus.

<Controller 130>

The controller 130 includes a central processing unit (CPU) 131, a read-only memory (ROM) 132, a random-access memory (RAM) 133, an electrically erasable programmable ROM (EEPROM) 134, and an application-specific integrated circuit (ASIC) 135, as illustrated in FIG. 7, which are mutually connected through an internal bus 137. Programs performed by the CPU 131 to control various operations and other items are stored in the ROM 132. The RAM 133 is used as a storage area in which data, signals, and the like that are used by the CPU 131 to perform the above programs are temporarily stored or as a working area used in data processing. Settings, flags, and the like that need to be retained even after power is turned off are stored in the EEPROM 134. The EEPROM 134 is an example of a memory unit.

The EEPROM 134 stores, for example, an initial flag. The initial flag indicates a value depending on whether ink has been refilled after the MFP 10 performed initial processing.

The first value is stored in the initial flag area when ink has not been refilled after execution of the initial processing, and is the second value is stored when ink has been refilled after execution of the initial processing. Further, the value stored in the initial flag area indicates whether the multi-function peripheral 10 has performed the initial processing. That is, the first or second values is stored in the initial flag are when the initial processing has already been performed, and the third value is stored when the initial processing has yet to be performed. The third value is stored in the initial flag are when the MFP 10 is shipped.

In initial processing, a flow path from the ink chamber 111 to the recording unit 24 (that is, the ink flow path 114 and ink tube 32) is filled with ink. The act of refilling ink following execution of the initial processing means that the ink chambers are refilled with ink due to a reduction of ink in the ink chambers as ink is injected to the recording unit 24 after the initial processing was performed. In other words, this act denotes the refilling of ink chambers with ink following execution of the initial processing. The act of not refilling ink following execution of the initial processing signifies that the ink chambers are not refilled with ink following execution of the initial processing.

The EEPROM 134 stores a counted value that indicates the amount of ink discharged from the recording head of the recording unit 24 for each ink color. The counted value stored in the EEPROM 134 is initialized (that is, set to 0) in steps S26 and S49 described later, and is incremented in step S69 described later. The counted value is compared with the first, second, third, and fourth discharge thresholds. The method of updating the counted value is not limited to the above example. For example, a counted value corresponding to the amount $V_{max}$ in the ink bottle may be set in steps S26 and S49 and may be decremented in step S69. The counted value to be decremented is compared with its corresponding remaining amount threshold.

The conveyor 23, recording unit 24 including the recording head, monitor 14, communication interface 25, operation panel 17, cover sensor 72, and ink sensor 125 are connected to the ASIC 135. The controller 130 controls the conveyor 23 to convey a sheet, controls the recording head of the recording unit 24 to eject ink, controls the monitor 14 to display information on the monitor 14, and controls the communication interface 25 to communicate with an external apparatus. The controller 130 receives operation signals from the operation panel 17, positional signals from the cover sensor 72, and signals from the ink sensor 125. The controller 130 reads, for example, positional signals output from the cover sensor 72 and signals output from the ink sensor 125 at predetermined intervals (for example, 50-ms intervals).

<Operations of the MFP 10>

Operations of the MFP 10 will be described with reference to FIGS. 8 to 13. Processing illustrated in FIGS. 8 to 13 is performed by the CPU 131 in the controller 130. To implement processing described below, the CPU 131 may read programs stored in the ROM 132 and may perform them. Alternatively, the processing may be implemented by a hardware circuit mounted in the controller 130.

<Processing when the Cover is Open>

Figure 8:
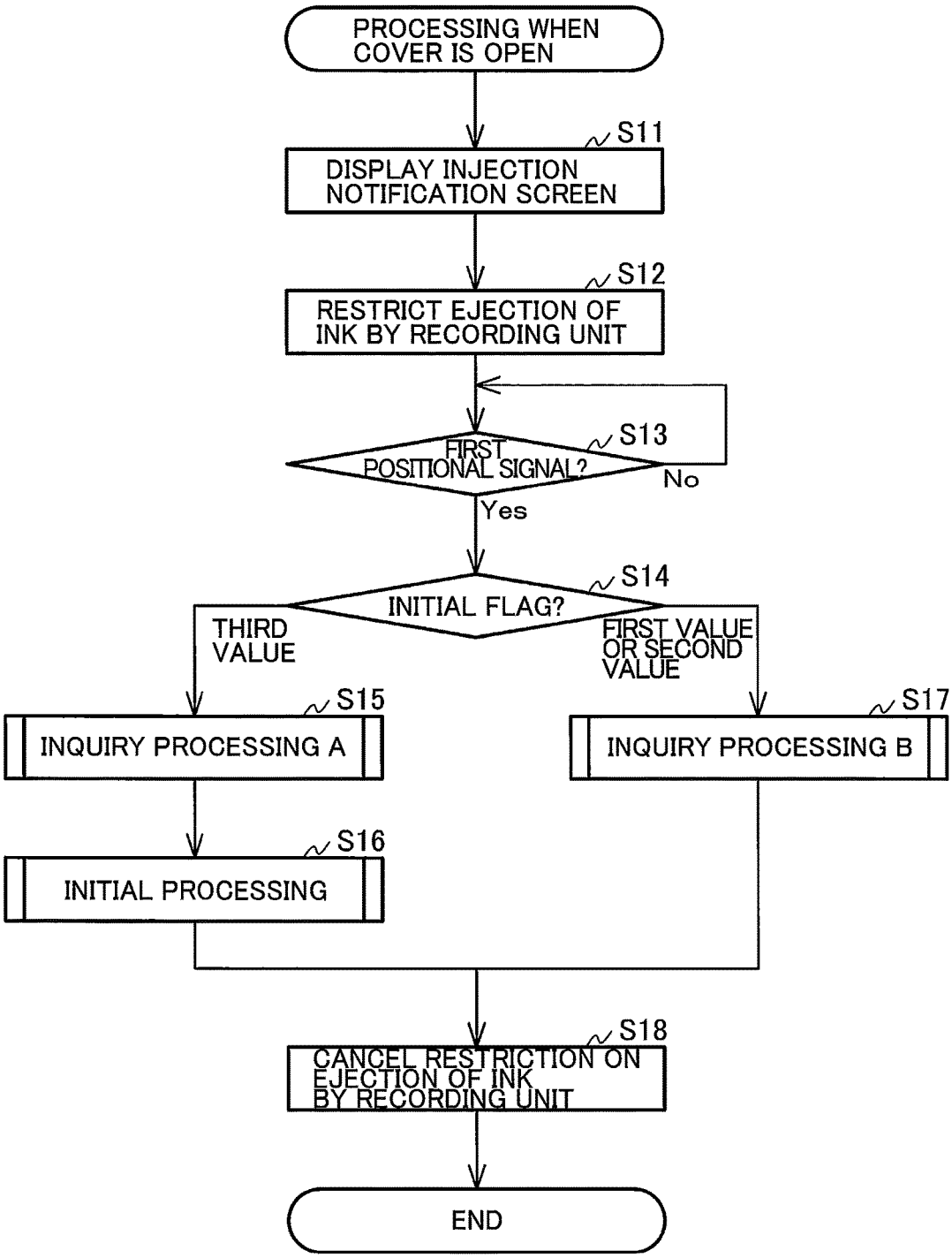
FIG. 8 is a flowchart illustrating processing performed when the cover is open.
Figure 9:
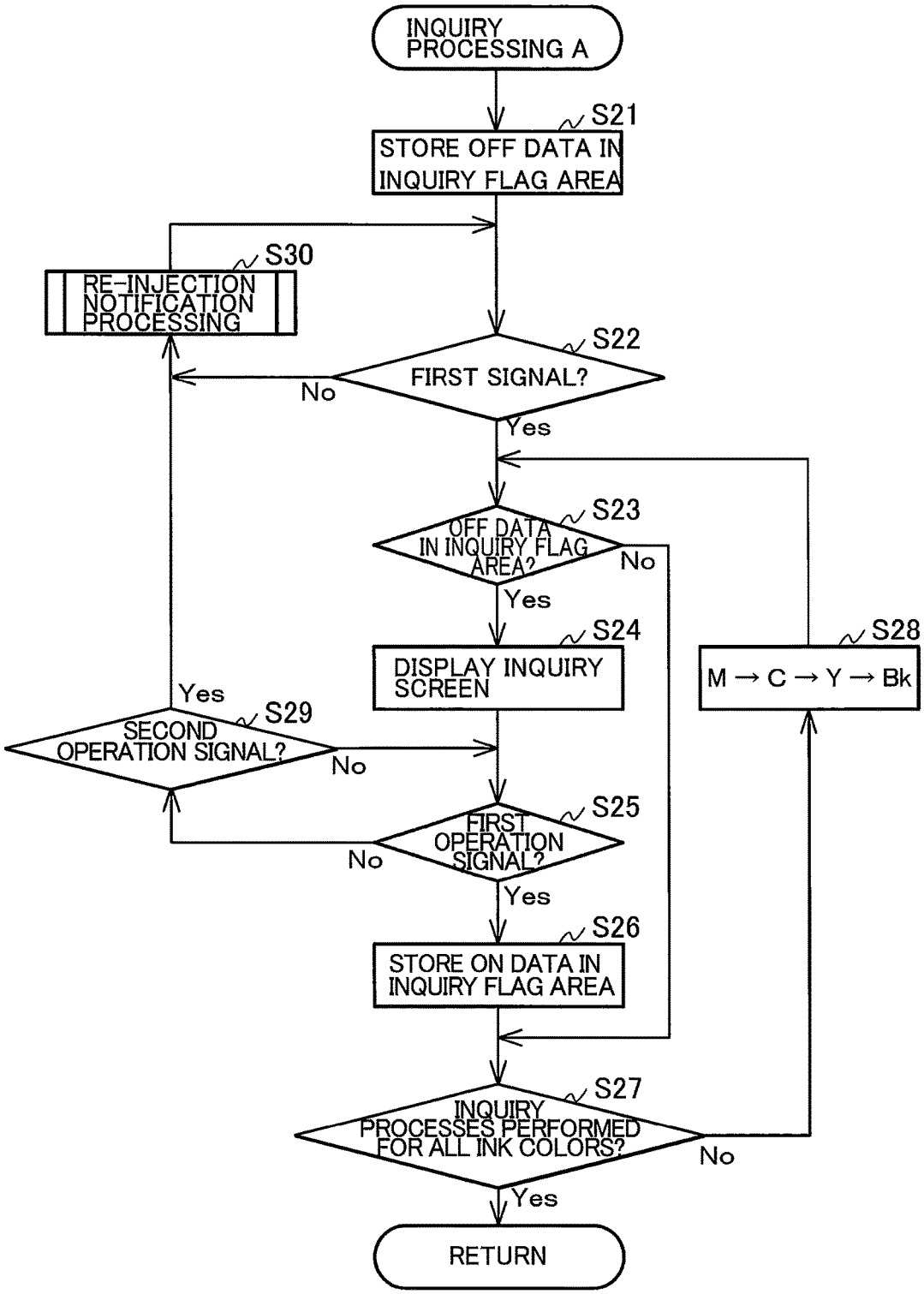
FIG. 9 is a flowchart in inquiry processing A.

First, the controller 130 performs processing illustrated in FIG. 8 in response to receipt of the second positional signal from the cover sensor 72. This processing is performed in response to, for example, the cover 70 being moved from the covered position to the exposed position while the MFP 10 is in a standby state (state in which image recording processing described later has not yet been performed). In this processing, the user is prompted to inject ink into the ink chamber 111 and is made inquiry whether ink injection into the ink chamber 111 is completed.

First, the controller 130 controls the monitor 14 to display an injection notification screen on the monitor 14 (S11). In step S11, based on the third value being stored in the initial flag area, the controller 130 controls the monitor 14 to alternately display a character string "FILL ALL INK" and a character string "THEN CLOSE INK COVER" on the monitor 14 as the injection notification screen.

In step S11, based on the first or second value being stored in the initial flag area, the controller 130 controls the monitor 14 to display other character strings on the monitor 14 depending on the counted value stored in the EEPROM 134. Specifically, based on the counted values for all ink colors being equal to or larger than the third discharge threshold and the first value is set in the initial flag, the controller 130 alternately displays a character string "REFILL M/C/Y/BK" and a character string "THEN CLOSE INK COVER" on the monitor 14. If a counted value for an ink color is smaller than the fourth discharge threshold, the letter representing the ink color (that is, M, C, Y, or BK, whichever is applicable, is eliminated from the character string "REFILL M/C/Y/BK"). If the counted values for all ink colors are smaller than the third discharge threshold, the controller 130 displays a character string "CLOSE INK COVER" on the monitor 14.

If the counted values for all ink colors are equal to or larger than the fourth discharge threshold and the second value is set in the initial flag, the controller 130 controls the monitor 14 to alternately display a character string "REFILL M/C/Y/BK" and a character string "THEN CLOSE INK COVER" on the monitor 14. Based on a counted value for an ink color being smaller than the third discharge threshold, the letter representing the ink color (that is, M, C, Y, or BK, whichever is applicable, is eliminated from the character string "REFILL M/C/Y/BK"). Based on the counted values for all ink colors being smaller than the fourth discharge threshold, the controller 130 controls the monitor 14 to display a character string "CLOSE INK COVER" on the monitor 14.

In the description below, an ink color for which the counted value is equal to or greater than the third discharge threshold (if the first value is stored in the initial flag area) or the fourth discharge threshold (if the second value is stored in the initial flag area) may be referred to as a near-empty color, and an ink color for which the counted value is equal to or greater than the first discharge threshold may be referred to as an empty color. That is, based on the first or second value being stored set in the initial flag area, the processing in S11 is to indicate, on the monitor 14, a prompt to inject inks in a near-empty color and an empty color.

Processing in step S11, the controller 130 continues notification processing until a situation in which the cover 70 at the covered position is detected in step S13, described later. In step S11, it may be allowed that a different character string is displayed on the monitor 14 depending on the state of the MFP 10. This is also true for steps S24, S31, S33, S41, S45, S81, and S83 described later.

The controller 130 also restricts the ejecting of ink by the recording head of the recording unit 24 (S12). Specifically, even if the controller 130 receives a recording instruction described later during a time between steps S12 and S19, the controller 130 does not start image recording processing illustrated in FIG. 12.

When the user views the notification screen regarding the ink injection, the user can remove the cap 113 from the injection inlet 112 and inject ink into the ink chamber 111. Upon completion of the ink injection, the user can close the injection inlet 112 with the cap 113 and can move the cover 70 to the covered position. In this case, the user may inject only ink in the ink color indicated on the notification screen regarding the ink injection, may inject inks in all colors, or may not inject ink in any color. However, the controller 130 cannot sense the ink color of the ink that has been injected.

Next, based on receipt of the first positional signal from the cover sensor 72 and the third value being stored in the initial flag area (the result in S13 is Yes and the result in S14 is the third value), the controller 130 performs inquiry processing A (S15). That is, based on the cover 70 being moved from the exposed position to the covered position in a state in which initial processing has not yet been completed in the MFP 10, the controller 130 performs inquiry processing A. Inquiry processing A will be described below in detail with reference to FIG. 9.

<Inquiry Processing Before Initial Processing>

First, the controller 130 stores off data in an inquiry flag area for each ink color (S21). The data in the inquiry flag area is temporarily stored in the RAM 133 at the time that the controller starts to perform processing in S23 to S25. Then, based on receipt of the first signal output from the ink sensor 125 (the result in S22 is Yes), the controller 130 performs inquiry processes (in S23 to S25 and S29) for each of the four ink colors. The first signal from the ink sensor 125 is present in step S22 in a case in which black ink injection into the ink chamber 111B has been completed. That is, if it is confirmed that at least black ink injection has been completed, the controller 130 performs inquiry processing A for each ink color.

The first positional signal in step S13 is an example of a completion signal indicating completion of the ink injection. However, specific examples of the completion signal are not limited to this. For example, the completion signal may be an operation signal output from the operation panel 17 upon receipt of a user's operation performed to indicate completion of ink injection. However, a method of checking whether black ink has been injected is not limited to a method in which a signal from the ink sensor 125 is used. Instead of the signal from the ink sensor 125, an operation signal may be used that is output from the operation panel 17 upon receipt of a user's operation performed to indicate completion of black ink injection.

Although an example in which these inquiry processes are performed for magenta, cyan, yellow, and black in that order will be performed, the order of the execution of the inquiry processes is not limited to this. This is also true for inquiry processing B described later in S45 to S48 and S51.

Based on an inquiry flag area for magenta being stored off data (the result in S23 is Yes), the controller 130 controls the monitor 14 to display an inquiry screen for magenta on the monitor 14 (S24). The inquiry screen includes inquiry information. The inquiry information regards whether ink, in the corresponding ink color, injection is completed. Inquiry information about magenta includes, for example, a character string "DID YOU FILL" and a character string "[M]? 1. YES 2. NO". The controller 130 controls the monitor 14 to alternately display these two character strings on the monitor 14.

Next, the controller 130 waits until one of the first operation signal and second operation signal is output from the operation panel 17 (the result in S25 No and the result in S29 is No). The user's operation of pressing the button labeled 1, which is included in the numeric keypad 17A, in step S25 is an example of a first operation performed to indicate completion of the ink injection. The user's operation of pressing the button labeled 2, which is included in the numeric keypad 17A, in step S29 is an example of a second operation performed to indicate that no completion of the ink injection. The first operation and second operation are not limited to these examples. For example, if the operation panel 17 includes an upward arrow button labeled ↑ and a downward arrow button labeled ↓, the pressing of the ↑ button may be the first operation and the pressing of the ↓ button may be the second operation.

The user's operation of pressing the power button 17B is an example of a third operation that commands execution of stop processing to stop power supply to the MFP 10. Even if, however, the third operation signal is output from the operation panel 17 in inquiry processing A (the result in S25 is No and the result in S29 is No), the controller 130 continues inquiry processing A without performing the stop processing corresponding to the third operation signal. Specific examples of the third operation are not limited to this. The third operation only needs to be different from the first operation and second operation. Other specific examples of the third operation include the pressing of buttons labeled 4 to 9, which are included in the numeric keypad 17A, the pressing of a COPY button, and the pressing of a SCAN button. Even if these buttons are pressed in inquiry processing A, the controller 130 ignores the operation signals corresponding to these pressed buttons and continues inquiry processing A.

Based on receipt of the first operation signal from the operation panel 17 (the result in S25 is Yes), the controller 130 initializes the counted value for magenta and stored on data in the inquiry flag area for magenta (S26). Processing to initialize the counted value in step S26 is an example of initializing processing.

Based on the inquiry processes have not yet been performed for all ink colors (the result in S27 is No), the controller 130 performs the inquiry processes for a next ink color (the sequence proceeds to S28, returns to S23 to S25, and proceeds to S29). Based on the inquiry processes have been performed for all ink colors (the result in S27 is Yes), the controller 130 terminates inquiry processing A.

Figure 10:
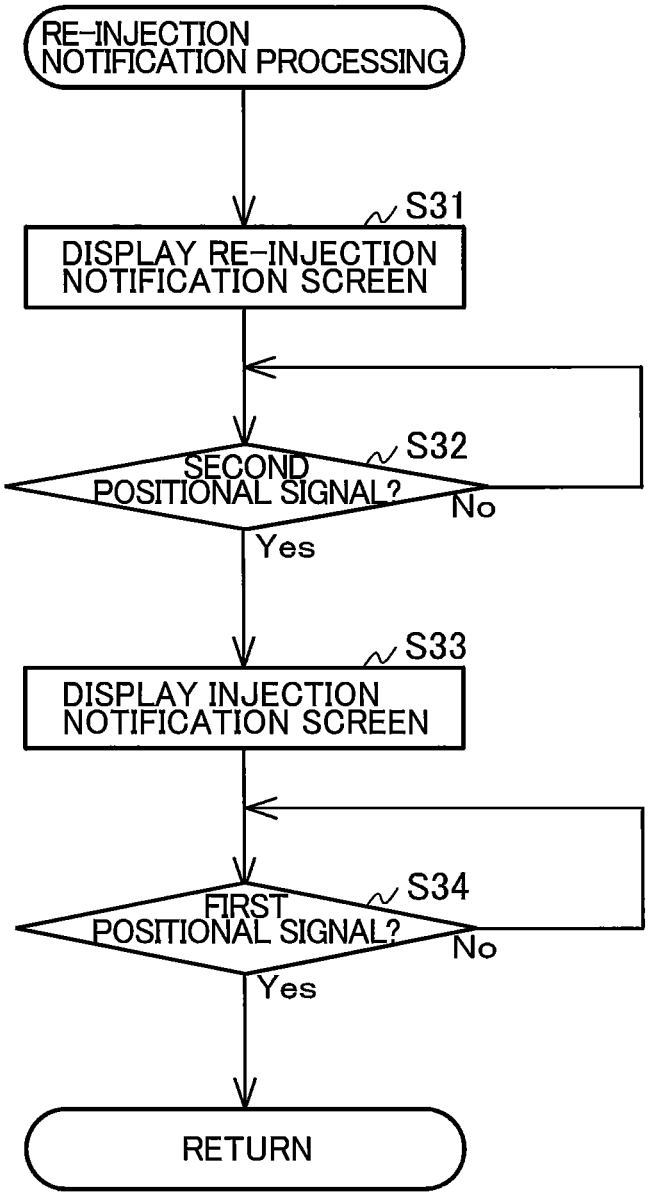
FIG. 10 is a flowchart in re-injection notification processing.
Figure 11:
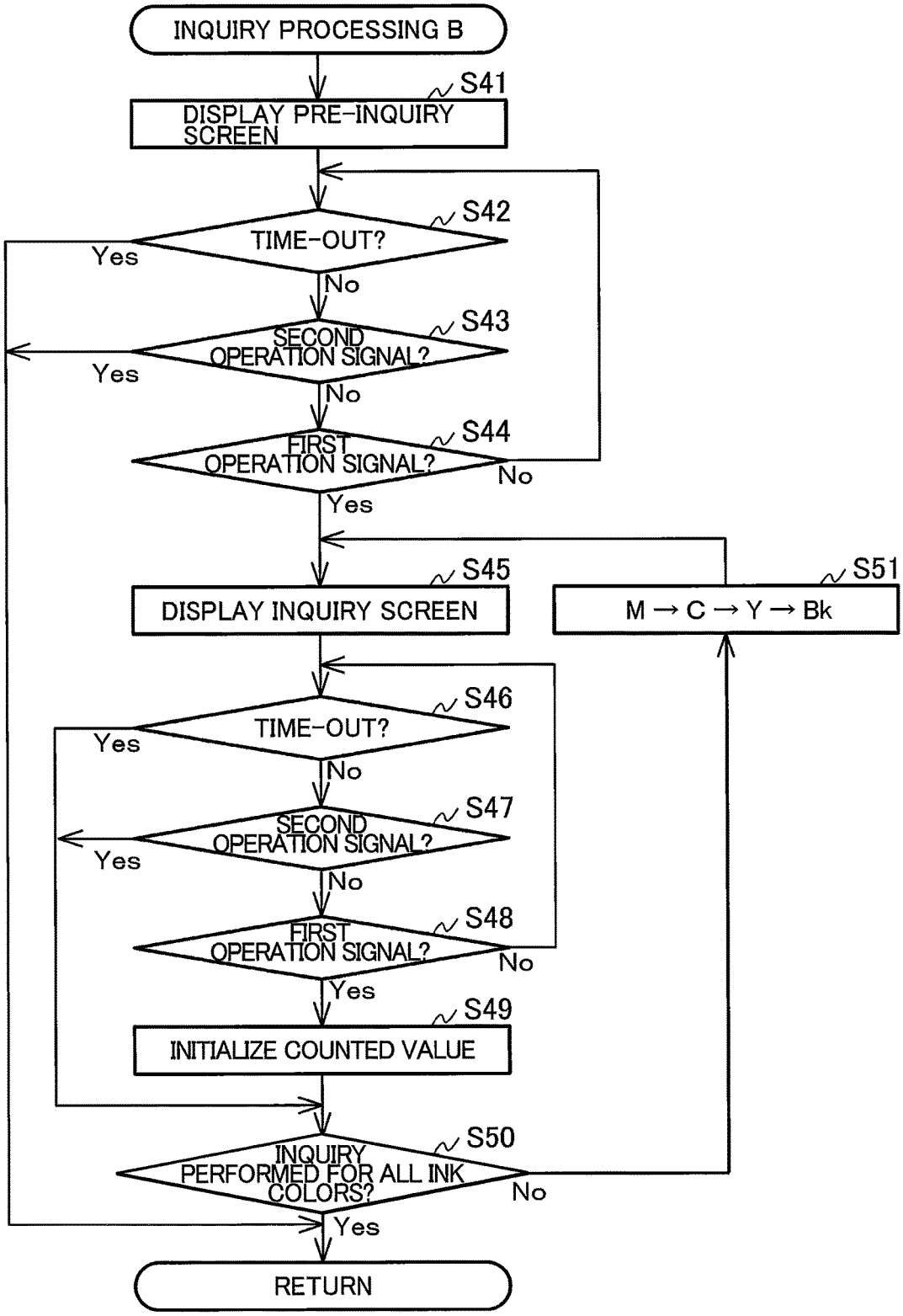
FIG. 11 is a flowchart in inquiry processing B.

Based on receipt of the second signal from the ink sensor 125 in step S22 (the result in S22 is No), the controller 130 performs re-injection notification processing illustrated in FIG. 10 (S30). Similarly, based on no receipt of the first operation signal from the operation panel 17 in step S25 (the result in S25 is No) and receipt of the second operation signal from the operation panel 17 in step S29 (the result in S29 is Yes), the controller 130 suspends the inquiry process in progress and performs re-injection notification processing (S30). In re-injection notification processing, the user is promoted to move the cover 70 to the exposed position and inject ink.

In re-injection notification processing illustrated in FIG. 10, the controller 130 controls the monitor 14 to display a re-injection notification screen on the monitor 14 (S31). The re-injection notification screen includes, for example, a character string "FILL INK" and a character string "OPEN INK COVER". The controller 130 alternately controls the monitor 14 to display these two character strings on the monitor 14.

Next, the controller 130 waits until the cover 70 is moved to the exposed position, in other words, waits until the controller 130 receivers the second positional signal from the cover sensor 72 (the result in S32 is No). At the same time, the controller 130 keeps the re-injection notification screen displayed (S31). In response to receipt of the second positional signal from the cover sensor 72 in step S32, processing in S33 and later is performed, instead of processing illustrated in FIG. 8. In response to receipt of the second positional signal from the cover sensor 72 (the result in S32 is Yes), the controller 130 controls the monitor 14 to display the injection notification screen on the monitor 14 as in step S11 (S33). Next, the controller 130 waits until the cover 70 is moved to the covered position, in other words, waits until the controller 130 receives the first positional signal from the cover sensor 72 (the result in S34 is No). At the same time, the controller 130 keeps the injection notification screen displayed (S33). In response to receipt of the first positional signal from the cover sensor 72 (the result in S34 is Yes), the controller 130 terminates re-injection notification processing and performs processing indicated in step S22 and later again.

The inquiry processes for other ink colors (S23 to S25 and S29) are also performed in the same way. In inquiry information for another ink color, for example, the letter corresponding to the other ink color (that is, C, Y, or BK, whichever is applicable) is placed at the position of [M] described above instead. In response to receipt of the first operation signal from the operation panel 17 in the inquiry process for the other ink color (the result in S25 is Yes), the controller 130 initializes the counted value for the other ink color and stores on data in the inquiry flag area for the other ink color (S26).

Based on the on data being stored in the inquiry flag area in S23 (the result in S23 is No), the controller 130 performs processing indicated in step S27 and later without performing steps S24 to S26 and S29. Based on, for example, the button labeled 1 being pressed in the inquiry processes for magenta and the button labeled 2 being pressed in the inquiry processes for cyan, after re-injection notification processing, the controller 130 performs the inquiry processes for cyan without performing the inquiry processes for magenta.

Although not illustrated, in response to receipt of the second positional signal from the cover sensor 72 during performing an inquiry process (specifically, while the controller 130 is waiting for receipt of the first operation or second operation), the controller 130 may suspend the inquiry process and may control the monitor 14 to display the injection notification screen on the monitor 14 again. Then, in response to receipt of the first positional signal from the cover sensor 72, the controller 130 may restart the suspended inquiry process.

Referring again to FIG. 8, the controller 130 performs initial processing (S16). Specifically, the controller 130 controls a pump (not illustrated) to suck air and ink included in the flow path extending from the ink chamber 111 to the recording head of the recording unit 24. The controller 130 also stores the first value in the initial flag area. Storing the second value in the initial flag area in EEPROM 134 is performed in an initial flag updating processing, which will be described later. The controller 130 then cancels the restriction on the ejection of ink by the recording head of the recording unit 24 (S19). That is, if the controller 130 receives a recording instruction after step S18, the controller 130 can perform image recording processing illustrated in FIG. 12.

Based on receipt of the first positional signal from the cover sensor 72 and the first or second value is stored in the initial flag in EEPROM 134 (the result in S13 is Yes and the result in S14 is the first or second value), the controller 130 performs inquiry processing B (S17). That is, if the cover 70 is moved from the exposed position to the covered position in a state in which initial processing has been already performed in the MFP 10, inquiry processing B is performed. Inquiry processing B will be described below in detail with reference to FIG. 11. However, detailed descriptions common to inquiry processing A and inquiring processing B will be omitted and differences between them will be mainly described.

<Inquiry Processing after Initial Processing>

First, the controller 130 controls the monitor 14 to display a pre-inquiry screen on the monitor 14 (S41). The pre-inquiry screen includes, for example, a character string "DID YOU REFILL" and a character string "INK? 1. YES 2. NO". The controller 130 controls the monitor 14 to alternately display these two character strings on the monitor 14. In addition, the controller 130 starts a timer for monitoring a threshold time in step S41.

Next, the controller 130 waits until the controller receives one of the first operation signal and second operation signal from the operation panel 17 (the result in S43 is No and the result in S44 is No) before the timer times out (the result in S42 is No). In response to occurring the a time-out, that is, a time elapsed from the start of the timer reaches the threshold time (the result in S42 is Yes) or in response to receipt of the second operation signal from the operation panel 17 before the timer times out (the result in S43 is Yes), the controller 130 terminates inquiry processing B.

In response to receipt of the first operation signal from the operation panel 17 (the result in S44 is Yes) without receipt of the second operation signal from the operation panel 17 (the result in S43 is No) before the timer times out (the result in S42 is No), the controller 130 performs processing indicated in step S45 and later. In response to receipt of one of the first operation signal and second operation signal from the operation panel 17 (the result S43 is Yes or the result in S44 is Yes), the controller 130 cancels the timer that has been started in step S41.

Next, the controller 130 controls the monitor 14 to display the inquiry screen for magenta on the monitor 14 (S45). Processing in step S45 is almost the same as processing in step S24. Step S45 differs from step S24 only in that the inquiry screen in step S45 includes a character string "DID YOU REFILL" instead of the character string "DID YOU FILL". The controller 130 also starts a timer for monitoring a threshold time in step S45. The controller 130 waits until the controller 130 receives one of the first operation signal and second operation signal from the operation panel 17 (the result in S47 is No and the result in S48 is No) before the timer times out (the result in S46 is No), as in steps S43 to S44. The threshold time monitored by the timer in step S46 may be the same as the threshold time monitored by the timer in step S42 or may differ from it.

In response to receipt of the first operation signal from the operation panel 17 (the result in S48 is Yes) without receipt of the second operation signal from the operation panel 17 (the result in S47 is No) before the timer times out (the result in S46 is No), the controller 130 initializes the counted value for magenta (S49). Processing in step S49 is an example of initializing processing. The controller 130 then sets the second value in the initial flag (S50). If the second value is already set in the initial flag, processing in S50 is not performed.

In response to a time elapsed from the start of the timer reaching the threshold time (the result in S46 is Yes) or in response to receipt of the second operation signal from the operation panel 17 (the result in S47 is Yes) before the timer times out, the controller 130 performs processing indicated in step S51 and later without performing processing indicated in step S49 or S50. In response to receipt of one of the first operation signal and second operation signal from the operation panel 17 (the result S47 is Yes or the result in S48 is Yes), the controller 130 cancels the timer that has been started in step S46.

Based on that the inquiry processes have not yet been performed for all ink colors (the result in S51 is No), the controller 130 performs the inquiry processes for a next ink color (the sequence proceeds to S52 and returns to S45 to S48). Based on that the inquiry processes have been performed for all ink colors (the result in S51 is Yes), the controller 130 terminates inquiry processing B. Furthermore, the controller 130 cancels the restriction on the ejecting ink by the recording head of the recording unit 24 (S18).

Unlike inquiry processing A, in response to that the power button 17B is pressed, that is, in response to receipt of the third operation signal from the operation panel 17 in inquiry processing B, the controller 130 terminates inquiry processing B and performs the stop processing described above. However, even if one of the buttons labeled 4 to 9, which are included in the numeric keypad 17A, the COPY button, or the SCAN button is pressed in inquiry processing B, the controller 130 ignores the operation signal corresponding to the pressed button and continues inquiry processing B, as in inquiry processing A.

<Image Recording Processing>

Figure 12:
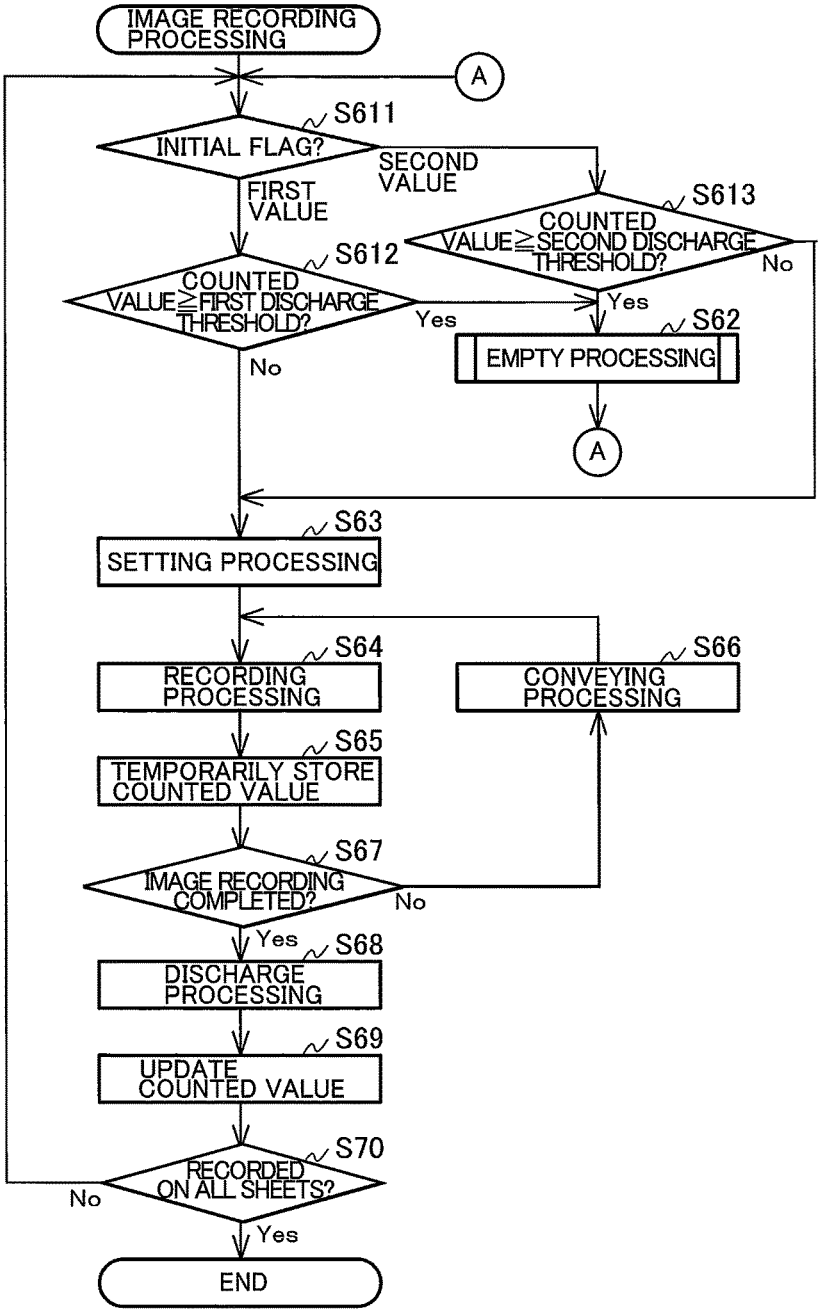
FIG. 12 is a flowchart in image recording processing.
Figure 13:
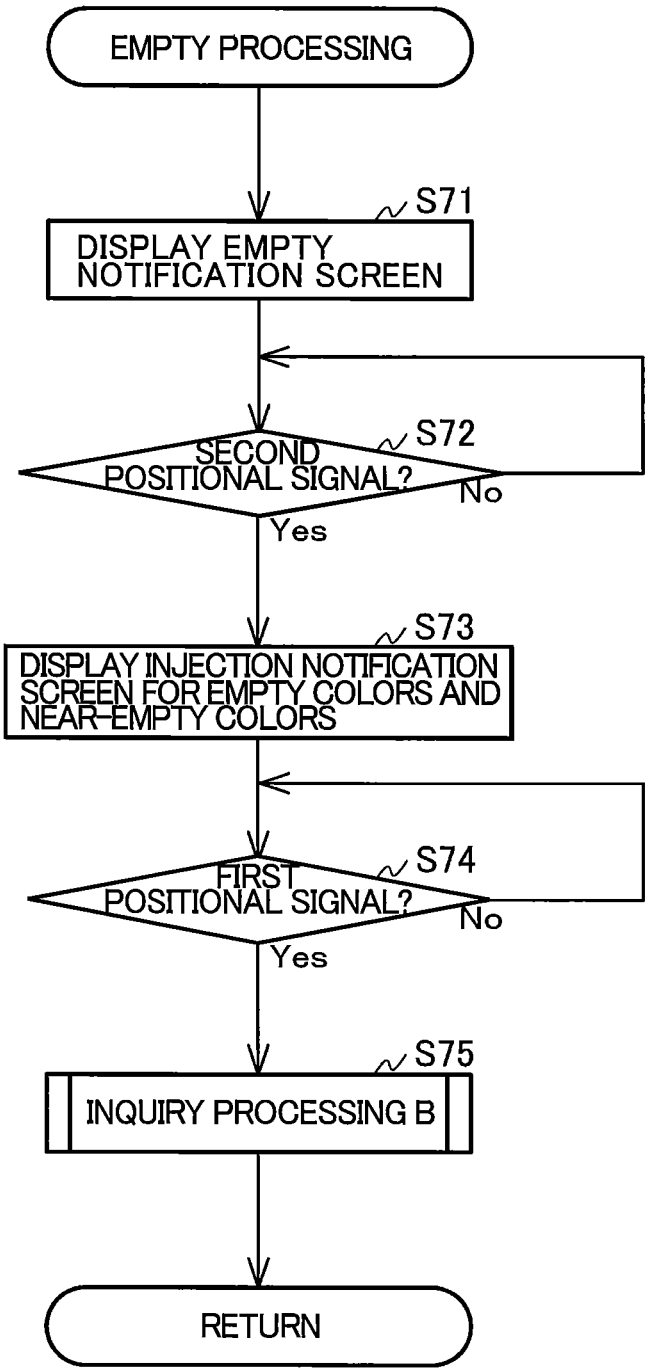
FIG. 13 is a flowchart in empty processing.

Next, based on receipt of a recording instruction through the communication interface 25, the controller 130 performs image recording processing illustrated in FIG. 12. However, even if the controller 130 receives a recording instruction with the third value stored in the initial flag area or during performing inquiry processing B, the controller 130 does not perform image recording processing. Image recording processing intended to be performed based on the recording instruction is performed based on the first or second value being stored in the initial flag area or after inquiry processing B is completed.

The recording instruction is an instruction to have the MFP 10 perform image recording processing in which an image indicated by image data is recorded on a sheet. There is no particular limitation on a source from which the recording instruction is received. For example, the recording instruction may be received from the user through the operation panel 17 or from an external apparatus through the communication interface 25. The recording instruction may be an instruction that instructs the recording of an image indicated by facsimile data on a sheet.

First, the controller 130 performs an empty ink chamber determining process in S611 to S613. In this process, the controller 130 compares the counted values for the four ink colors to thresholds corresponding to the value of the initial flag.

More specifically, in S611 the controller 130 determines whether the first value or the second value is stored in the initial flag area. If the first value is stored in the initial flag area (S611: first value), the controller 130 compares each counted value to the corresponding first discharge threshold in S612. If the second value is stored in the initial flag area (S611: second value), the controller 130 compares each counted value to the corresponding second discharge threshold in S613.

If the controller 130 determines through this empty ink chamber determining process that there exists a counted value corresponding to any one of the four ink colors that either exceeds the first discharge threshold (when the first value is stored in the initial flag; S612: YES) or the second discharge threshold (when the second value is stored in the initial flag area; S613: YES), in S62 the controller 130 performs the empty processing. The empty processing is performed to prompt the user to refill ink for colors whose ink chambers have become low. The empty processing will be described in detail with reference to FIG. 13.

First, the controller 130 controls the monitor 14 to display an empty notification screen on the monitor 14 (S81). Processing in step S81 is an example of processing to indicate, on the monitor 14, that the remaining amounts of ink in empty colors are small. The empty notification screen includes a character string "CANNOT PRINT" and at least one of a character string "REFILL [BK] INK", a character string "REFILL [Y] INK", a character string "REFILL [C] INK", and a character string "REFILL [M] INK" in correspondence to empty colors. The controller 130 controls the monitor 14 to alternately display, on the monitor 14, "CANNOT PRINT" and at least one of "REFILL [BK] INK", "REFILL [Y] INK", "REFILL [C] INK", and "REFILL [M] INK" in correspondence to empty colors as character strings on the empty notification screen.

For example, based on the condition that the first value is stored in the initial flag area, that the counted values for magenta and black are equal to or greater than the first discharge threshold, and that the counted values for cyan and yellow are smaller than the first discharge threshold, the controller 130 controls the monitor 14 to display the character string "CANNOT PRINT", the character string "REFILL [M] INK", and the character string "REFILL [BK] INK" in turn on the monitor 14 in step S81. When the user views the empty notification screen, the user can move the cover 70 to the exposed position to inject the corresponding inks into the ink tank 100.

In the example described above, based on the condition that the first value is stored in the initial flag area and that the counted values for any ink colors have reached the first discharge threshold, the controller 130 performs a process to notify the user through the monitor 14 that the ink chambers 111 must be filled with ink. This process of notifying the user is an example of the first notification process.

For example, based on the condition that the second value is in the initial flag area, that the counted values corresponding to magenta and black are greater than or equal to the second discharge threshold, and that the counted values corresponding to cyan and yellow are less than the second discharge threshold, the control unit in S81 130 displays sequentially on the monitor 14 the character string "CANNOT PRINT," the character string "REFILL 'M' INK," and the character string "REFILL 'BK' INK." Upon seeing this empty notification screen on the monitor 14, the user can move the cover 70 to its exposed position in order to fill the ink tank 100 with ink.

In the example described above, if the initial flag is set to the second value, the controller 130 performs a process for notifying the user via the monitor 14 that the ink chambers 111 must be filled with ink when any of the counted values have reached the second discharge threshold. This process of notifying the user is an example of the second notification process.

Next, the controller 130 waits until the cover 70 is moved to the exposed position, in other words, waits until the controller 130 receives the second positional signal from the cover sensor 72 (the result in S82 is No). At the same time, the controller 130 keeps the empty notification screen displayed (S81). In response to receipt of the second positional signal from the cover sensor 72 in step S82, processing in step S83 and later is performed instead of processing illustrated in FIG. 8. In response to receipt of the second positional signal from the cover sensor 72 (the result in S82 is Yes), the controller 130 controls the monitor 14 to display the injection notification screen for empty colors and near-empty colors on the monitor 14 (S83). Processing in S83 is the same as processing in step S11. Processing in step S83 is an example of processing to indicate, on the monitor 14, a prompt to inject inks in near-empty colors and empty colors.

In the example described above, based on the condition that the counted value for yellow is equal to or greater than the first discharge threshold, that the counted value for cyan is smaller than the first discharge threshold, and that the first value is stored in the initial flag area, the controller 130 controls the monitor 14 to alternately display a character string "REFILL M/Y/BK" and a character string "THEN CLOSE INK COVER" on the monitor 14. Otherwise, based on the condition that the counted value for yellow being equal to or greater than the second discharge threshold, that the counted value for cyan is smaller than the second discharge threshold, and that the second value is stored in the initial flag area, the controller 130 also displays a character string "REFILL M/Y/BK" and a character string "THEN CLOSE INK COVER" on the monitor 14. When the user views the injection notification screen, the user can inject the corresponding ink into the ink chamber 111 and can move the cover 70 to the covered position.

Next, the controller 130 waits until the cover 70 is moved to the covered position, in other words, waits until the controller 130 receives the first positional signal from the cover sensor 72 (the result in S84 is No). At the same time, the controller 130 keeps the injection notification screen displayed (S83). In response to receipt of the first positional signal from the cover sensor 72 (the result in S84 is Yes), the controller 130 performs inquiry processing B illustrated in FIG. 11 (S85). That is, inquiry processing B is performed when the cover 70 is moved from the exposed position to the covered position. In inquiry processing B, counted values for ink colors for which the first operation has been made are initialized. Inquiry processing B has been already described with reference to FIG. 11, so a repeated description will be omitted.

Based on all counted values being smaller than the first discharge threshold (when the first value is set in the initial flag) or the second discharge threshold (when the second value is set in the initial flag) (the result in S612 is No or the result in S613 is No), the controller 130 performs setting processing (S63). In setting processing, the controller 130 controls the conveyor 23 to convey a sheet to a position at which an area in which an image is first recorded faces the recording head of the recording unit 24.

Next, the controller 130 performs recording processing (S64). In recording processing, the controller 130 controls the recording head of the recording unit 24 to eject ink. That is, an image is recorded on the sheet that has been made to face the recording head of the recording unit 24. The controller 130 also counts the amount of ink ejected from the recording head of the recording unit 24 in recording processing for each ink color and temporarily stores the counted value in the RAM 133 (S65). Steps S64 and S65 may be concurrently performed.

Next, based on that image recording on the sheet has not yet been completed (the result in step S66 is No), the controller 130 performs conveying processing (S67). In conveying processing, the controller 130 controls the conveyor 23 to convey a sheet by a predetermined line feed width. The controller 130 repeatedly performs processing indicated in steps S64 to S67 until image recording on the sheet is completed (the result in step S66 is No).

Next, based on that image recording on the sheet has been completed (the result in step S66 is Yes), the controller 130 performs discharge processing (S68). In discharge processing, a sheet on which an image has been recorded is discharged to the discharge tray 21. The controller 130 then updates the counted value in the EEPROM 134 by using the counted value that is temporarily stored in the RAM 133 (S69). Processing in steps S69 is an example of count processing.

A timing at which to update the counted value is not limited to a timing at which step S69 is performed. For example, in so-called flushing processing, in which the recording head of the recording unit 24 ejects ink toward an ink receiver (not illustrated) for maintenance of the recording head of the recording unit 24, or a so-called purge processing, in which a pump (not illustrated) sucks ink in the recording head of the recording unit 24, the amount of ink ejected or discharged from the recording head of the recording unit 24 in the flushing processing or purge processing may be added to the corresponding counted value.

The controller 130 then repeatedly performs processing indicated in steps S611 to S613 and S62 to S69 until all images instructed by recording instructions are recorded on sheets (the result in step S70 is No). Based on all images instructed by recording instructions have been recorded on sheets (the result in step S70 is Yes), the controller 130 terminates image recording processing.

<Technical Effects>

As described above, after the controller 130 has performed the initial processing for filling the ink flow paths from the ink tank 100 to the recording head of the recording unit 24 with ink, the controller 130 displays a notification on the monitor 14 indicating that the ink chambers 111 must be filled with ink before the ink tank 100 becomes completely depleted based on the first discharge threshold. After the ink chambers 111 have been refilled with ink at least once following the initial processing, the controller 130 thereafter displays a message on the monitor 14 indicating that the ink chambers 111 must be filled with ink based on the second discharge threshold, which is larger than the first discharge threshold. Thus, even if the ink chambers 111 are replenished with ink while ink still remains therein, thereafter the controller 130 will prompt the user to fill the ink chambers 111 with ink when the residual quantity of ink is approximately equal to the level at which ink was first replenished following the initial processing.

As described above, ink chambers 111 in the ink tank 100 are each replenished with ink from a single bottle, and the second discharge threshold is slightly larger (by a small amount) than the quantity of ink contained in one bottle. Thus, after ink has been replenished once following the initial processing, the controller 130 prompts the user to fill ink chambers 111 with ink every time one bottle worth of ink is consumed.

A described above, the ink chambers 111 have corresponding recessed parts 119 that include the spare retaining chambers and the corresponding openings 115B, 115M, 115C, and 115Y formed therein. The openings 115B, 115M, 115C, and 115Y are included in the corresponding spare retaining chambers that constitute the recessed parts 119. With this configuration, the controller 130 prompts the user to fill ink chambers 111 with ink when ink only remains in the spare retaining chambers.

As described above, the controller 130 performs the initial flag updating processing. In this process, the controller 130 can update the initial flag in response to a user's operation.

What is claimed is:

1. An inkjet recording apparatus comprising:

a tank forming an ink chamber and including an injection inlet;

a recording head configured to discharge ink from the ink chamber;

a monitor, and a controller configured to control operation of the recording head and the monitor, wherein the controller is configured to:

decide whether complement of ink injection into the ink chamber is a first time or a second time;

count an amount of ink discharged from the recording head;

based on decision that the complement of the ink injection into the ink chamber is the first time and based on the counted amount of discharged ink being greater than or equal to a first threshold value, control the monitor to display a first notification on the monitor; and based on decision that the complement of the ink injection into the ink chamber is the second time and based on the counted amount of discharged ink being greater than or equal to a second threshold greater than the first threshold value, control the monitor to display a second notification on the monitor.

2. The inkjet recording apparatus according to claim 1, wherein the tank comprises:

an upper stage wall defining a bottom of the ink chamber, and a lower stage wall defining the bottom of the ink chamber, wherein at least part of the lower stage wall is positioned lower than the upper stage wall.

3. The inkjet recording apparatus according to claim 2, wherein the lower stage wall is positioned lower than the upper stage wall.

4. The inkjet recording apparatus according to claim 3, wherein the tank comprises the connecting wall connecting the upper stage wall and the lower stage wall and intersecting both the upper stage wall and the lower stage wall.

5. The inkjet recording apparatus according to claim 2, wherein the tank comprises a side wall defining a side of the ink chamber, intersecting the lower stage wall and connected to the lower stage wall.

6. The inkjet recording apparatus according to claim 5, wherein the ink chamber includes a recessed part defined by both the lower stage wall and the side wall.

7. The inkjet recording apparatus according to claim 6, wherein the first threshold value is less than the second value by at least the volume of the recessed part.

8. The inkjet recording apparatus according to claim 7, wherein the ink chamber is configured to be injected through the injection inlet with ink from a bottle that contains ink, and wherein the second threshold value is greater than a volume of the bottle.

9. The inkjet recording apparatus according to claim 7, wherein the first threshold value is less than the volume of the bottle.

10. The inkjet recording apparatus according to claim 6, wherein the recessed part is positioned lower than the upper stage wall.

11. The inkjet recording apparatus according to claim 6, wherein the tank is formed with an outlet communicated with the recording head and the ink chamber, and wherein the outlet is in the recessed part.

12. The inkjet recording apparatus according to claim 11, wherein the outlet is formed on the side wall.

13. The inkjet recording apparatus according to claim 6, wherein the tank comprises a front wall defining a front of the ink chamber;

wherein a front part of the upper stage wall is connected to the front wall, and wherein the recessed part is positioned lower than a connecting point corresponding to a point at which the front wall and the upper stage wall are connected to each other.

14. The inkjet recording apparatus according to claim 6, further comprising a cover covering the tank and including a window, wherein the tank comprises a front wall defining a front of the ink chamber and being a translucent;

wherein the window is configured so that the front wall is visible through the window, and wherein the recessed part is lower than a bottom of the window.

15. The inkjet recording apparatus according to the claim 1, wherein the controller is configured to control the monitor to display the first and second notifications including a prompt of ink injection into the ink chamber.

16. The inkjet recording apparatus according to the claim 1, wherein the controller is configured to control the monitor to display the first and second notifications including being not able to record.

17. The inkjet recording apparatus according to claim 1, wherein the first notification and the second notification are same.

18. The inkjet recording apparatus according to claim 1, wherein the controller includes a memory including an initial flag area configured to store either a first value or a second value based on whether ink injection into the ink chamber after complement of an initial process is completed, the first value to be stored before the first time of the complement of the ink injection into the ink chamber and the second value to be stored after the first time of the complement of the ink injection into the ink chamber, and wherein the controller is configured to decide that the complement of the ink injection into the ink chamber is the first time based on the first value being stored in the initial flag area of the memory.

19. The inkjet recording apparatus according to claim 18, wherein the controller is configured to decide that the complement of the ink injection into the ink chamber is second time based on the second value being stored in the initial flag area of the memory.

20. The inkjet recording apparatus according to claim 1, further comprising an operation panel configured to receive user input, wherein the controller is configured to, after displaying the first notification, control the monitor to display inquiry information on the monitor regarding whether ink injection into the ink chamber is completed and control the operation panel to allow the receipt at the operation panel of a response to the inquiry information.

21. The inkjet recording apparatus according to claim 20, wherein the controller is configured to, based on receipt of one response to the inquiry information, decide that the complement of the ink injection into the ink chamber is the second time, and wherein the one response is corresponding to completion of the ink injection.

22. The inkjet recording apparatus according to claim 20, wherein the controller is configured to, based on receipt of the response to the inquiry information, initialize the counted amount of discharged ink, and wherein the one response is corresponding to completion of the ink injection.

23. The inkjet recording apparatus according to claim 20, wherein the controller is configured to, after displaying the second notification, control the monitor to display the inquiry information on the monitor and control the operation panel to allow the receipt at the operation panel pf the response to the inquiry information.

24. The inkjet recording apparatus according to claim 1, wherein the controller is configured to, based on decision that the complement of the ink injection into the ink chamber is the first time, control the recording head to perform the initial process corresponding to filling a flow path from the ink chamber to the recording head with ink, and wherein the controller is configured to count the amount of ink discharged from the recording head in the initial process.

25. The inkjet recording apparatus according to claim 1, further comprising a plurality of ink chambers and a plurality of injection inlets, each of the plurality of ink chambers associated with a different one of the plurality of injection inlets.

26. The inkjet recording apparatus according to claim 25, wherein the tank forms the plurality of the ink chambers and the plurality of the injection inlets.

27. An inkjet recording apparatus comprising:

a tank forming an ink chamber and including an injection inlet;

a recording head configured to discharge ink from the ink chamber, and a controller configured to control operation of the recording head, wherein the controller is configured to:

decide whether complement of ink injection into the ink chamber is a first time or a second time;

count an amount of ink discharged from the recording head;

based on decision that the complement of the ink injection into the ink chamber is the first time and based on the counted amount of discharged ink being greater than or equal to a first threshold value, decide that the ink chamber is empty irrespective of the amount of ink in the ink chamber;

based on decision that the complement of the ink injection into the ink chamber is the second time and based on the counted amount of discharged ink being greater than or equal to a second threshold greater than the first threshold value, decide that the ink chamber is empty irrespective of the amount of ink in the ink chamber.

28. An inkjet recording apparatus comprising:

a tank forming an ink chamber and including an injection inlet;

a recording head configured to discharge ink from the ink chamber;

a monitor, and a controller configured to control operation of the recording head and the monitor, wherein the controller is configured to:

decide whether complement of ink injection into the ink chamber is a first time or a second time;

count an amount of ink discharged from the recording head;

based on decision that the complement of the ink injection into the ink chamber is the first time and based on the counted amount of discharged ink being greater than or equal to a first threshold value, control the monitor to display a notification on the monitor; and based on decision that the complement of the ink injection into the ink chamber is the second time and based on the counted amount of discharged ink being greater than or equal to a second threshold greater than the first threshold value, control the monitor to display the notification on the monitor.

* * * * *